US009573099B2

(12) United States Patent
Weitz et al.

(10) Patent No.: US 9,573,099 B2
(45) **Date of Patent: *Feb. 21, 2017**

(54) CONTROL OF EMULSIONS, INCLUDING MULTIPLE EMULSIONS

(71) Applicants: President and Fellows of Harvard College, Cambridge, MA (US); BASF SE, Ludwigshafen (DE)

(72) Inventors: David A. Weitz, Bolton, MA (US); Assaf Rotem, Newton, MA (US); Adam R. Abate, San Francisco, CA (US); Christian Holtze, Frankfurt (DE)

(73) Assignee: President and Fellows of Harvard College, Cambridge, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/961,460

(22) Filed: Dec. 7, 2015

(65) Prior Publication Data

US 2016/0193574 A1 Jul. 7, 2016

Related U.S. Application Data

(63) Continuation of application No. 13/477,636, filed on May 22, 2012, now Pat. No. 9,238,206.

(Continued)

(51) Int. Cl.
*B01F 3/08* (2006.01)
*B01F 13/00* (2006.01)

(52) U.S. Cl.
CPC ..... *B01F 3/0811* (2013.01); *B01F 3/0807* (2013.01); *B01F 13/0062* (2013.01); *B01F 13/0084* (2013.01); *Y10T 137/87571* (2015.04)

(58) Field of Classification Search
CPC ..... B01F 3/0807; B01F 13/0059

(Continued)

(56) References Cited

U.S. PATENT DOCUMENTS 2,379,816 A 7/1945 Mabbs
2,918,263 A 12/1959 Eichhorn (Continued)

FOREIGN PATENT DOCUMENTS

CH 563807 A5 7/1975
CN 1695809 A 11/2005

(Continued)

OTHER PUBLICATIONS

Chinese Office Action mailed Jul. 10, 2015 for Application No. 201080039023.3.

(Continued)

*Primary Examiner* — David Sorkin
(74) *Attorney, Agent, or Firm* — Wolf, Greenfield & Sacks, P.C.

(57) ABSTRACT

The present invention generally relates to emulsions, and more particularly, to double and other multiple emulsions. Certain aspects of the present invention are generally directed to the creation of double emulsions and other multiple emulsions at a common junction of microfluidic channels. In some cases, the microfluidic channels at the common junction may have substantially the same hydrophobicity. In one set of embodiments, a device may include a common junction of six or more channels, where a first fluid flows through one channel, a second fluid flows through two channels, and a third or carrying fluid flows through two more channels, such that a double emulsion of a first droplet of the first fluid, contained in a second droplet of the second fluid, contained by the carrying fluid, flows away from the common junction through a sixth channel. Other aspects of the invention are generally directed to methods of making and using such systems, kits involving such systems, emulsions created using such systems, or the like.

11 Claims, 7 Drawing Sheets

Related U.S. Application Data

(60) Provisional application No. 61/489,211, filed on May 23, 2011.

(58) Field of Classification Search
USPC ..... 366/162.4, 336, 341
See application file for complete search history.

(56) References Cited

U.S. PATENT DOCUMENTS 3,505,244 A 4/1970 Cessna
3,675,901 A 7/1972 Rion
3,816,331 A 6/1974 Brown et al.
3,980,541 A 9/1976 Aine
4,251,195 A 2/1981 Suzuki et al.
4,279,345 A 7/1981 Allred
4,422,985 A 12/1983 Morishita et al.
4,508,265 A 4/1985 Jido
4,695,466 A 9/1987 Morishita et al.
4,732,930 A 3/1988 Tanaka et al.
4,743,507 A 5/1988 Franses et al.
4,865,444 A 9/1989 Green et al.
4,880,313 A 11/1989 Loquenz et al.
4,888,140 A 12/1989 Schlameus et al.
4,931,225 A 6/1990 Cheng
4,978,483 A 12/1990 Redding, Jr.
4,996,265 A 2/1991 Okubo et al.
5,100,933 A 3/1992 Tanaka et al.
5,149,625 A 9/1992 Church et al.
5,204,112 A 4/1993 Hope et al.
5,209,978 A 5/1993 Kosaka et al.
5,216,096 A 6/1993 Hattori et al.
5,232,712 A 8/1993 Mills et al.
5,326,692 A 7/1994 Brinkley et al.
5,378,957 A 1/1995 Kelly
5,418,154 A 5/1995 Aebischer et al.
5,452,955 A 9/1995 Lundstrom
5,500,223 A 3/1996 Behan et al.
5,512,131 A 4/1996 Kumar et al.
5,617,997 A 4/1997 Kobayashi et al.
5,681,600 A 10/1997 Antinone et al.
5,762,775 A 6/1998 DePaoli et al.
5,795,590 A 8/1998 Kiefer et al.
5,849,055 A 12/1998 Arai et al.
5,851,769 A 12/1998 Gray et al.
5,882,680 A 3/1999 Suzuki et al.
5,888,538 A 3/1999 Kiefer et al.
5,935,331 A 8/1999 Naka et al.
5,942,443 A 8/1999 Parce et al.
5,980,936 A 11/1999 Krafft et al.
6,004,525 A 12/1999 Tani et al.
6,046,056 A 4/2000 Parce et al.
6,116,516 A 9/2000 Ganan-Calvo
6,119,953 A 9/2000 Ganan-Calvo et al.
6,120,666 A 9/2000 Jacobson et al.
6,149,789 A 11/2000 Benecke et al.
6,150,180 A 11/2000 Parce et al.
6,174,469 B1 1/2001 Ganan-Calvo
6,187,214 B1 2/2001 Ganan-Calvo
6,189,803 B1 2/2001 Ganan-Calvo
6,193,951 B1 2/2001 Ottoboni et al.
6,196,525 B1 3/2001 Ganan-Calvo
6,197,835 B1 3/2001 Ganan-Calvo
6,221,654 B1 4/2001 Quake et al.
6,234,402 B1 5/2001 Ganan-Calvo
6,238,690 B1 5/2001 Kiefer et al.
6,241,159 B1 6/2001 Ganan-Calvo et al.
6,248,378 B1 6/2001 Ganan-Calvo
6,251,661 B1 6/2001 Urabe et al.
6,267,858 B1 7/2001 Parce et al.
6,274,337 B1 8/2001 Parce et al.
6,299,145 B1 10/2001 Ganan-Calvo
6,301,055 B1 10/2001 Legrand et al.
6,306,659 B1 10/2001 Parce et al.
6,355,198 B1 3/2002 Kim et al.
6,357,670 B2 3/2002 Ganan-Calvo
6,380,297 B1 4/2002 Zion et al.
6,386,463 B1 5/2002 Ganan-Calvo
6,394,429 B2 5/2002 Ganan-Calvo
6,399,389 B1 6/2002 Parce et al.
6,405,936 B1 6/2002 Ganan-Calvo
6,408,878 B2 6/2002 Unger et al.
6,429,025 B1 8/2002 Parce et al.
6,432,148 B1 8/2002 Ganan-Calvo
6,432,630 B1 8/2002 Blankenstein
6,450,189 B1 9/2002 Ganan-Calvo
6,464,886 B2 10/2002 Ganan-Calvo
6,489,103 B1 12/2002 Griffiths et al.
6,506,609 B1 1/2003 Wada et al.
6,508,988 B1 1/2003 Van Dam et al.
6,524,456 B1 2/2003 Ramsey et al.
6,540,895 B1 4/2003 Spence et al.
6,554,202 B2 4/2003 Ganan-Calvo
6,557,834 B2 5/2003 Ganan-Calvo
6,558,944 B1 5/2003 Parce et al.
6,558,960 B1 5/2003 Parce et al.
6,560,030 B2 5/2003 Legrand et al.
6,592,821 B1 7/2003 Wada et al.
6,608,726 B2 8/2003 Legrand et al.
6,610,499 B1 8/2003 Fulwyler et al.
6,614,598 B1 9/2003 Quake et al.
6,630,353 B1 10/2003 Parce et al.
6,645,432 B1 11/2003 Anderson et al.
6,660,252 B2 12/2003 Matathia et al.
6,752,922 B2 6/2004 Huang et al.
6,790,328 B2 9/2004 Jacobson et al.
6,806,058 B2 10/2004 Jesperson et al.
6,890,487 B1 5/2005 Sklar et al.
6,935,768 B2 8/2005 Lowe et al.
7,041,481 B2 5/2006 Anderson et al.
7,068,874 B2 6/2006 Wang et al.
7,115,230 B2 10/2006 Sundararajan et al.
7,268,167 B2 9/2007 Higuchi et al.
7,374,332 B2 5/2008 Higashino et al.
7,638,276 B2 12/2009 Griffiths et al.
7,651,770 B2 1/2010 Berkland et al.
7,708,949 B2 5/2010 Stone et al.
7,776,927 B2 8/2010 Chu et al.
RE41,780 E 9/2010 Anderson et al.
7,968,287 B2 6/2011 Griffiths et al.
8,252,539 B2 8/2012 Quake et al.
8,273,573 B2 9/2012 Ismagilov et al.
8,278,071 B2 10/2012 Brown et al.
8,302,880 B2 11/2012 Clarke
8,329,407 B2 12/2012 Ismagilov et al.
8,439,487 B2 5/2013 Clarke et al.
8,685,323 B2 4/2014 Nam et al.
8,697,008 B2 4/2014 Clarke et al.
8,741,192 B2 6/2014 Torii et al.
8,748,102 B2 6/2014 Berka et al.
8,765,380 B2 7/2014 Berka et al.
8,772,046 B2 7/2014 Fraden et al.
8,871,444 B2 10/2014 Griffiths et al.
9,039,273 B2 5/2015 Weitz et al.
9,238,206 B2 * 1/2016 Rotem ..... B01F 3/0807
2002/0004532 A1 1/2002 Matathia et al.
2002/0008028 A1 1/2002 Jacobson et al.
2002/0009473 A1 1/2002 Tebbe
2002/0119459 A1 8/2002 Griffiths
2003/0015425 A1 1/2003 Bohm et al.
2003/0039169 A1 2/2003 Ehrfeld et al.
2003/0077204 A1 * 4/2003 Seki ..... B01F 5/0471 422/70
2003/0124509 A1 7/2003 Kenis et al.
2003/0124586 A1 7/2003 Griffiths et al.
2003/0180485 A1 9/2003 Nakajima et al.
2003/0227820 A1 * 12/2003 Parrent ..... B01F 5/0256 366/162.4
2004/0058198 A1 3/2004 Wang et al.
2004/0068019 A1 4/2004 Higuchi et al.
2004/0096515 A1 5/2004 Bausch et al.
2004/0182712 A1 9/2004 Basol
2005/0032238 A1 2/2005 Karp et al.
2005/0032240 A1 2/2005 Lee et al.
2005/0172476 A1 8/2005 Stone et al.

(56) References Cited

U.S. PATENT DOCUMENTS

| | | | |
|---|---|---|---|
| 2005/0183995 | A1 | 8/2005 | Deshpande et al. |
| 2005/0207940 | A1 | 9/2005 | Butler et al. |
| 2005/0221339 | A1 | 10/2005 | Griffiths et al. |
| 2006/0051329 | A1 | 3/2006 | Lee et al. |
| 2006/0078888 | A1 | 4/2006 | Griffiths et al. |
| 2006/0078893 | A1 | 4/2006 | Griffiths et al. |
| 2006/0108012 | A1 | 5/2006 | Barrow et al. |
| 2006/0153924 | A1 | 7/2006 | Griffiths et al. |
| 2006/0163385 | A1 | 7/2006 | Link et al. |
| 2006/0196644 | A1 | 9/2006 | Boger et al. |
| 2006/0263888 | A1 | 11/2006 | Fritz et al. |
| 2007/0000342 | A1 | 1/2007 | Kazuno |
| 2007/0003442 | A1 | 1/2007 | Link et al. |
| 2007/0009668 | A1 | 1/2007 | Wyman et al. |
| 2007/0054119 | A1 | 3/2007 | Garstecki et al. |
| 2007/0056853 | A1 | 3/2007 | Aizenberg et al. |
| 2007/0092914 | A1 | 4/2007 | Griffiths et al. |
| 2007/0172827 | A1 | 7/2007 | Murakami |
| 2007/0172873 | A1 | 7/2007 | Brenner et al. |
| 2007/0195127 | A1 | 8/2007 | Ahn et al. |
| 2007/0196397 | A1 | 8/2007 | Torii et al. |
| 2008/0003142 | A1 | 1/2008 | Link et al. |
| 2008/0004436 | A1 | 1/2008 | Tawfik et al. |
| 2008/0014589 | A1 | 1/2008 | Link et al. |
| 2009/0012187 | A1 | 1/2009 | Chu et al. |
| 2009/0068170 | A1 | 3/2009 | Weitz et al. |
| 2009/0131543 | A1 | 5/2009 | Weitz et al. |
| 2009/0191276 | A1 | 7/2009 | Kim et al. |
| 2009/0197772 | A1 | 8/2009 | Griffiths et al. |
| 2009/0235990 | A1 | 9/2009 | Beer |
| 2009/0286687 | A1 | 11/2009 | Dressman et al. |
| 2010/0129422 | A1 | 5/2010 | Han et al. |
| 2010/0130369 | A1 | 5/2010 | Shenderov et al. |
| 2010/0136544 | A1 | 6/2010 | Agresti et al. |
| 2010/0137163 | A1 | 6/2010 | Link et al. |
| 2010/0163109 | A1 | 7/2010 | Fraden et al. |
| 2010/0170957 | A1 | 7/2010 | Clarke |
| 2010/0173394 | A1 | 7/2010 | Colston, Jr. et al. |
| 2010/0188466 | A1 | 7/2010 | Clarke |
| 2010/0210479 | A1 | 8/2010 | Griffiths et al. |
| 2010/0213628 | A1 | 8/2010 | Bausch et al. |
| 2010/0238232 | A1 | 9/2010 | Clarke et al. |
| 2011/0086780 | A1 | 4/2011 | Colston, Jr. et al. |
| 2011/0092392 | A1 | 4/2011 | Colston, Jr. et al. |
| 2011/0116993 | A1 | 5/2011 | Nam et al. |
| 2011/0123413 | A1 | 5/2011 | Abate et al. |
| 2011/0160078 | A1 | 6/2011 | Fodor et al. |
| 2011/0229545 | A1 | 9/2011 | Shum et al. |
| 2011/0305761 | A1 | 12/2011 | Shum et al. |
| 2012/0010107 | A1 | 1/2012 | Griffiths et al. |
| 2012/0015382 | A1 | 1/2012 | Weitz et al. |
| 2012/0048882 | A1 | 3/2012 | Clarke et al. |
| 2012/0053250 | A1 | 3/2012 | Carrick et al. |
| 2012/0108721 | A1 | 5/2012 | Mazutis |
| 2012/0168010 | A1 | 7/2012 | Bauer et al. |
| 2012/0190032 | A1 | 7/2012 | Ness et al. |
| 2012/0199226 | A1 | 8/2012 | Weitz et al. |
| 2012/0211084 | A1 | 8/2012 | Weitz et al. |
| 2012/0220494 | A1 | 8/2012 | Samuels et al. |
| 2012/0220497 | A1 | 8/2012 | Jacobson et al. |
| 2013/0046030 | A1 | 2/2013 | Rotem et al. |
| 2013/0064862 | A1 | 3/2013 | Weitz et al. |
| 2013/0079231 | A1 | 3/2013 | Pushkarev et al. |
| 2013/0109575 | A1 | 5/2013 | Kleinschmidt et al. |
| 2013/0157899 | A1 | 6/2013 | Adler, Jr. et al. |
| 2013/0210639 | A1 | 8/2013 | Link et al. |
| 2013/0274117 | A1 | 10/2013 | Church et al. |
| 2013/0277461 | A1 | 10/2013 | Ripoll et al. |
| 2014/0065234 | A1 | 3/2014 | Shum et al. |
| 2014/0151912 | A1 | 6/2014 | Nam et al. |
| 2014/0155295 | A1 | 6/2014 | Hindson et al. |
| 2014/0220350 | A1 | 8/2014 | Kim et al. |
| 2014/0227684 | A1 | 8/2014 | Hindson et al. |
| 2014/0235506 | A1 | 8/2014 | Hindson et al. |
| 2014/0378349 | A1 | 12/2014 | Hindson et al. |
| 2015/0005200 | A1 | 1/2015 | Hindson et al. |
| 2015/0285282 | A1 | 10/2015 | Weitz et al. |
| 2015/0285285 | A1 | 10/2015 | Burbach |

FOREIGN PATENT DOCUMENTS

| | | | |
|---|---|---|---|
| CN | 1772363 | A | 5/2006 |
| CN | 1933898 | A | 3/2007 |
| CN | 101721964 | A | 6/2010 |
| CN | 101856603 | A | 10/2010 |
| CN | 102014871 | A | 4/2011 |
| DE | 43 08 839 | A1 | 9/1994 |
| DE | 199 61 257 | A1 | 7/2001 |
| DE | 100 15 109 | A1 | 10/2001 |
| DE | 100 41 823 | A1 | 3/2002 |
| DE | 102005048259.00 | A1 | 4/2007 |
| EP | 0 249 007 | A2 | 12/1987 |
| EP | 0 272 659 | A2 | 6/1988 |
| EP | 0 478 326 | A1 | 4/1992 |
| EP | 0 718 038 | B1 | 10/2002 |
| EP | 1 362 634 | A1 | 11/2003 |
| EP | 1358931 | A2 | 11/2003 |
| EP | 1019496 | B1 | 9/2004 |
| EP | 1595597 | A2 | 11/2005 |
| EP | 1 757 357 | A1 | 2/2007 |
| EP | 1482036 | B1 | 10/2007 |
| EP | 1 741 482 | A2 | 1/2008 |
| EP | 1594980 | B1 | 11/2009 |
| EP | 1967592 | B1 | 4/2010 |
| EP | 2258846 | A2 | 12/2010 |
| EP | 2 283 918 | A2 | 2/2011 |
| EP | 2283918 | A2 | 2/2011 |
| EP | 2 289 613 | A2 | 3/2011 |
| EP | 2145955 | B1 | 2/2012 |
| EP | 1905828 | B1 | 8/2012 |
| EP | 1908832 | B1 | 12/2012 |
| EP | 2540389 | A1 | 1/2013 |
| FR | 2696658 | A1 | 4/1994 |
| GB | 1 422 737 | | 1/1976 |
| GB | 1 446 998 | | 8/1976 |
| GB | 2 433 448 | A | 6/2007 |
| JP | 54-107880 | A | 8/1979 |
| JP | 56-130219 | A | 10/1981 |
| JP | 60-040055 | A | 3/1985 |
| JP | H10-219222 | A | 8/1998 |
| JP | H11-509768 | A | 8/1999 |
| JP | 2004-202476 | A | 7/2004 |
| JP | 2004-351417 | A | 12/2004 |
| JP | 2005-144356 | A | 6/2005 |
| JP | 2005-152740 | A | 6/2005 |
| JP | 2005-152773 | A | 6/2005 |
| JP | 2006-507921 | A | 3/2006 |
| JP | 2006-523142 | A | 10/2006 |
| JP | 2008-535644 | A | 9/2008 |
| JP | 2008-238146 | A | 10/2008 |
| JP | 2011-041925 | A | 3/2011 |
| JP | S51-008875 | B2 | 12/2012 |
| WO | WO 96/29629 | A2 | 9/1996 |
| WO | WO 00/70080 | A1 | 11/2000 |
| WO | WO 00/76673 | A1 | 12/2000 |
| WO | WO 01/12327 | A1 | 2/2001 |
| WO | WO 01/68257 | A1 | 9/2001 |
| WO | WO 01/69289 | A2 | 9/2001 |
| WO | WO 01/72431 | A1 | 10/2001 |
| WO | WO 01/85138 | A2 | 11/2001 |
| WO | WO 01/89787 | A2 | 11/2001 |
| WO | WO 01/89788 | A2 | 11/2001 |
| WO | WO 01/94635 | A2 | 12/2001 |
| WO | WO 02/18949 | A2 | 3/2002 |
| WO | WO 02/47665 | A2 | 6/2002 |
| WO | WO 02/68104 | A1 | 9/2002 |
| WO | WO 02/103011 | A2 | 12/2002 |
| WO | WO 03/011443 | A2 | 2/2003 |
| WO | WO 03/068381 | A1 | 8/2003 |
| WO | WO 2004/002627 | A2 | 1/2004 |
| WO | WO 2004/038363 | A2 | 5/2004 |
| WO | WO 2004/071638 | A2 | 8/2004 |
| WO | WO 2004/091763 | A2 | 10/2004 |
| WO | WO 2005/002730 | A1 | 1/2005 |

(56) References Cited

FOREIGN PATENT DOCUMENTS

| | | | |
|---|---|---|---|
| WO | WO 2005/021151 | A1 | 3/2005 |
| WO | WO 2005/049787 | A2 | 6/2005 |
| WO | WO 2005/084210 | A2 | 9/2005 |
| WO | WO 2005/089921 | A1 | 9/2005 |
| WO | WO 2005/103106 | A1 | 11/2005 |
| WO | WO 2006/002641 | A1 | 1/2006 |
| WO | WO 2006/078841 | A1 | 7/2006 |
| WO | WO 2006/096571 | A2 | 9/2006 |
| WO | WO 2006/101851 | A2 | 9/2006 |
| WO | WO 2007/001448 | A2 | 1/2007 |
| WO | WO 2007/024410 | A2 | 3/2007 |
| WO | WO 2007/081385 | A2 | 7/2007 |
| WO | WO 2007/089541 | A2 | 8/2007 |
| WO | WO 2007/133807 | A2 | 11/2007 |
| WO | WO 2008/058297 | A2 | 5/2008 |
| WO | WO 2008/109176 | A2 | 9/2008 |
| WO | WO 2008/121342 | A2 | 10/2008 |
| WO | WO 2008/134153 | A1 | 11/2008 |
| WO | WO 2009/020633 | A2 | 2/2009 |
| WO | WO 2009/048532 | A2 | 4/2009 |
| WO | WO 2009/061372 | A1 | 5/2009 |
| WO | WO 2009/075652 | A1 | 6/2009 |
| WO | WO 2009/120254 | A1 | 10/2009 |
| WO | WO 2010/104597 | A2 | 9/2010 |
| WO | WO 2010/104604 | A1 | 9/2010 |
| WO | WO 2010/121307 | A1 | 10/2010 |
| WO | WO 2011/001185 | A2 | 1/2011 |
| WO | WO 2011/028760 | A2 | 3/2011 |
| WO | WO 2011/028764 | A2 | 3/2011 |
| WO | WO 2012/048341 | A1 | 4/2012 |
| WO | WO 2013/177220 | | 11/2013 |

OTHER PUBLICATIONS

Chinese Office Action dated Jan. 16, 2015 for Application No. CN 201280024857.6.

Chinese Office Action dated Oct. 24, 2014 for Application No. 201080039023.3.

Chinese Office Action for Application No. CN 201080039023.3 mailed Dec. 23, 2013.

Chinese Office Action for Application No. CN 201280024857.6 mailed Sep. 14, 2015.

European Office Action dated Mar. 24, 2015 for Application No. 12725967.9.

European Office Action for Application No. 12725967.9 mailed Nov. 19, 2015.

Ex Parte Quayle Action for Application No. 13/477,636 mailed Aug. 3, 2015.

Extended European Search Report for Application No. EP 10814401.5 mailed Nov. 3, 2015.

International Preliminary Report on Patentability for PCT/US2010/047467 mailed Mar. 15, 2012.

International Preliminary Report on Patentability for PCT/US2012/038957 mailed Dec. 5, 2013.

International Search Report and Written Opinion for PCT/US2010/047467 mailed May 26, 2011.

International Search Report and Written Opinion for PCT/US2012/038957 mailed Dec. 13, 2012.

Invitation to Pay Additional Fees for PCT/US2012/038957 mailed Sep. 5, 2012.

Japanese Office Action dated Jul. 22, 2014 for Application No. JP 2012-527995.

Japanese Office Action for Application No. JP 2014-512944 mailed Mar. 15, 2016.

Japanese Office Action mailed Jun. 11, 2015 for Application No. 2012-527995.

Office Action dated Jun. 16, 2016 for U.S. Appl. No. 13/388,596.

Office Action for U.S. Appl. No. 13/388,596 mailed Nov. 23, 2015.

[No Author Listed] ATP Determination Kit (A-22066). Molecular Probes. Product Information. 2003. 3 pages. Revised Apr. 23, 2003.

[No Author Listed] Experimental Soft Condensed Matter Group. Cool Picture of the Moment. Available at http://www.seas.harvard.edu/projects /weitzlab/coolpic16012007.html dated Jan. 16, 2007.

[No Author] "Parafin Wax". http://www.wikipedia.com [last accessed Feb. 15, 2014].

[No Author] "Wax". http://www.wikipedia.com [last accessed Feb. 15, 2014].

[No Author] Microfluidic ChipShop. Microfluidic product catalogue. Mar. 2005.

[No Author] Microfluidic ChipShop. Microfluidic product catalogue. Oct. 2009.

[No Auhtor Listed], Toxnet, Toxicology Data Network. Vinyl Toluene. National Library of Medicine. 2015:1-38.

Abate et al. One-step formation of multiple emulsions in microfluidics. Lab on a Chip. Lab Chip. Jan. 21, 2011;11(2):253-8. Epub Oct. 22, 2010. DOI:10.1039/COLC00236D. 6 pages.

Abate et al., High-order multiple emulsions formed in poly(dimethylsiloxane) microfluidics. Small. Sep. 2009;5(18):2030-2.

Adams et al., Entropically driven microphase transitions in mixtures of colloidal rods and spheres. Nature. May 28, 1998:393:349-52.

Adams et al., Smart Capsules: Engineering new temperature and pressure sensitive materials with microfluidics. MAR10 Meeting of The American Physical Society. Mar. 15-19, 2010. Portland, Oregon. Submitted Nov. 20, 2009. Last accessed Jun. 14, 2012 at http://absimage.aps.org/image/MAR10/MWS_MAR10-2009-007422.pdf. Abstract only. 1 page.

Ahn et al., Dielectrophoretic manipulation of drops for high-speed microfluidic sorting devices. Applied Physics Letters. 2006;88:024104. 3 pages. Month not cited on publication.

Ando et al., PLGA microspheres containing plasmid DNA: preservation of supercoiled DNA via cryopreparation and carbohydrate stabilization. J Pharm Sci. Jan. 1999;88(1):126-30.

Anna et al., Formation of dispersions using "flow focusing" in microchannels. Applied Physics Letters. Jan. 20, 2003;82(3):364-6.

Benichou et al., Double Emulsions Stabilized by New Molecular Recognition Hybrids of Natural Polymers. Polym Adv Tehcnol. 2002;13:1019-31. Month not cited on publication.

Bibette et al., Emulsions: basic principles. Rep Prog Phys. 1999;62:969-1033. Month not cited on publication.

Boone, et al. Plastic advances microfluidic devices. The devices debuted in silicon and glass, but plastic fabrication may make them hugely successful in biotechnology application. Analytical Chemistry. Feb. 2002; 78A-86A.

Chang et al. Controlled double emulsification utilizing 3D PDMS microchannels. Journal of Micromechanics and Microengineering. May 9, 2008;18:1-8.

Chao et al., Control of Concentration and Volume Gradients in Microfluidic Droplet Arrays for Protein Crystallization Screening. 26$^{th}$ Annual International Conference of the IEEE Engineering in Medicine and Biology Society. Francisco, California. Sep. 1-5, 2004. 4 pages.

Chao et al., Droplet Arrays in Microfluidic Channels for Combinatorial Screening Assays. Hilton Head 2004: A Solid State Sensor, Actuator and Microsystems Workshop. Hilton Head Island, South Carolina. Jun. 6-10, 2004:382-3.

Chen et al., Capturing a photoexcited molecular structure through time-domain x-ray absorption fine structure. Science. Apr. 13, 2001;292(5515):262-4.

Chen et al., Microfluidic Switch for Embryo and Cell Sorting. The 12th International Conference on Solid State Sensors, Actuators, and Microsystems. Boston, MA. Jun. 8-12, 2003. Transducers. 2003:659-62.

Cheng et al., Electro flow focusing in microfluidic devices. Microfluidics Poster, presented at DEAS, "Frontiers in Nanoscience," presented Apr. 10, 2003. 1 page.

Chiba et al., Controlled protein delivery from biodegradable tyrosine-containing poly(anhydride-co-imide) microspheres. Biomaterials. Jul. 1997;18(13):893-901.

Chou, et al. Disposable Microdevices for DNA Analysis and Cell Sorting. Proc. Solid-State Sensor and Actuator Workshop, Hilton Head, SC. Jun. 8-11, 1998; 11-14.

(56) References Cited

OTHER PUBLICATIONS

Chu et al., Controllable monodisperse multiple emulsions. Ang Chem Int Ed. 2007:46:8970-4. Published online Sep. 11, 2007.
Chung et al., Human embryonic stem cell lines generated without embryo destruction. Cell Stem Cell. Feb. 7, 2008;2(2):113-7. doi: 10.1016/j.stem.2007.12.013. Epub Jan. 10, 2008.
Cohen et al., Controlled delivery systems for proteins based on poly(lactic/glycolic acid) microspheres. Pharm Res. Jun. 1991;8(6):713-20.
Cole, Gelatin. Encyclopedia of Food Science and Technology. Second Ed. Francis, ed. 2000:1183-8. http://www.gelatin.co.za/gltn1.html [last accessed Feb. 15, 2014].
Collins et al., Microfluidic flow transducer based on the measurement of electrical admittance. Lab Chip. Feb. 2004;4(1):7-10. Epub Nov. 11, 2003. (E-pub version).
Collins et al., Optimization of Shear Driven Droplet Generation in a Microfluidic Device. ASME International Mechanical Engineering Congress and R&D Expo. Washington, D.C. Nov. 15-21, 2003. 4 pages.
Cortesi et al., Production of lipospheres as carriers for bioactive compounds. Biomaterials. Jun. 2002;23(11):2283-94.
Dendukuri et al. Continuous-flow lithography for high-throughput microparticle synthesis. Nature Mat. May 2006;5:365-69.
Diaz et al., One-month sustained release microspheres of $^{125}$I-bovine calcitonin In vitro-in vivo studies. Journal of Controlled Release. 1999;59:55-62. Month not cited on publication.
Dinsmore et al., Colloiclosomes: Selectively-Permeable Capsules Composed of Colloidal Particles. Supplementary Material (Nov. 2002). Available at http://people.umass.edu/dinsmore/pdf_files/colloidosome_supplementary.pdf . 6 pages.
Dinsmore et al., Colloidosomes: selectively permeable capsules composed of colloidal particles. Science. Nov. 1, 2002;298(5595):1006-9.
Discher et al., Polymersomes: tough vesicles made from diblock copolymers. Science. May 14, 1999;284(5417):1143-6.
Dove et al., Research News. Nature Biotechnology. Dec. 2002;20:1213.
Dowding et al., Oil core-polymer shell microcapsules prepared by internal phase separation from emulsion droplets. I. Characterization and release rates for microcapsules with polystyrene shells. Langmuir. Dec. 21, 2004;20(26):11374-9.
Durant et al., Effects of cross-linking on the morphology of structured latex particles 1. Theoretical considerations. Macromol. 1996;29:8466-72. Month not cited on publication.
Edris et al., Encapsulation of orange oil in a spray dried double emulsion. Nahrung/Food. Apr. 2001;45(2):133-7.
Eow et al., Electrocoalesce-separators for the separation of aqueous drops from a flowing dielectric viscous liquid. Separation and Purification Technology. 2002;29:63-77.
Eow et al., Electrostatic and hydrodynamic separation of aqueous drops in a flowing viscous oil. Chemical Engineering and Processing. 2002;41:649-57.
Eow et al., Electrostatic enhancement of coalescence of water droplets in oil: a review of the technology. Chemical Engineering Journal. 2002;85:357-68.
Eow et al., Motion, deformation and break-up of aqueous drops in oils under high electric field strengths. Chemical Engineering and Processing. 2003;42:259-72.
Eow et al., The behaviour of a liquid-liquid interface and drop-interface coalescence under the influence of an electric field. Colloids and Surfaces A: Physiochem Eng Aspects. 2003;215:101-23.
Estes et al., Electroformation of giant liposomes from spin-coated films of lipids. Colloids Surf B Biointerfaces. May 10, 2005;42(2):115-23.
Fisher et al., Cell Encapsulation on a Microfluidic Platform. The Eighth International Conference on Miniaturised Systems for Chemistry and Life Sciences. MicroTAS. Malmo, Sweden. Sep. 26-30, 2004. 3 pages.
Fu et al., A microfabricated fluorescence-activated cell sorter. Nat Biotechnol. Nov. 1999;17(11):1109-11.
Fujiwara et al., Calcium carbonate microcapsules encapsulating biomacromolecules. Chemical Engineering Journal. Feb. 13, 2008;137(1):14-22.
Gallarate et al., On the stability of ascorbic acid in emulsified systems for topical and cosmetic use. Int J Pharm. Oct. 25, 1999;188(2):233-41.
Gañán-Calvo et al., Perfectly monodisperse microbubbling by capillary flow focusing. Phys Rev Lett. Dec. 31, 2001;87(27 Pt 1):274501. Epub Dec. 11, 2001. 4 pages.
Ganan-Calvo, Generation of Steady Liquid Microthreads and MicronSized Monodisperse Sprays in Gas Streams. Physical Review Letters. Jan. 12, 1998;80(2):285-8.
Ganan-Calvo, Perfectly monodisperse micro-bubble production by novel mechanical means. Scaling laws. American Physical Society 53rd Annual Meeting of the Division of Fluid Dynamics. Nov. 19-21, 2000. 1 page.
Gartner, et al. The Microfluidic Toolbox—examples for fluidic interfaces and standardization concepts. Proc. SPIE 4982, Microfluidics, BioMEMS, and Medical Microsystems, (Jan. 17, 2003); doi: 10.1117/12.479566.
Ghadessy et al. Directed evolution of polymerase function by compartmentalized self-replication. Proc Natl Acad Sci USA. Apr. 10, 2001; 98(8):4552-7. Epub Mar. 27, 2001.
Gordon et al., Self-assembled polymer membrane capsules inflated by osmotic pressure. JACS. 2004;126:14117-22. Published on web Oct. 12, 2004.
Graham et al., Nanogels and microgels: The new polymeric materials playground. Pure Appl Chem. 1998;70(6):1271-75. Month not cited on publication.
Grasland-Mongrain et al., Droplet coalescence in microfluidic devices. Jan.-Jul. 2003:1-30.
Griffiths et al., Man-made enzymes—from design to in vitro compartmentalisation. Curr Opin Biotechnol. Aug. 2000;11(4):338-53.
Griffiths et al., Miniaturising the Laboratory in Emulsion Droplets. Trends Biotechnol. Sep. 2006;24(9):395-402. Epub Jul. 14, 2006. (E-pub version).
Guery et al., Diffusion through colloidal shells under stress. Phys Rev E Stat Nonlin Soft Matter Phys. Jun. 2009;79(6 Pt 1):060402. Epub Jun. 29, 2009. 4 pages.
Hadd et al., Microchip device for performing enzyme assays. Anal Chem. Sep. 1, 1997;69(17):3407-12.
Hanes et al., Degradation of porous poly(anhydride-co-imide) microspheres and implications for controlled macromolecule delivery. Biomaterials. Jan.-Feb. 1998;19(1-3):163-72.
Hayward et al., Dewetting instability during the formation of polymersomes from block-copolymer-stabilized double emulsions. Langmuir. May 9, 2006;22(10):4457-61.
Holtze et al., Biocompatible surfactants for water-in-fluorocarbon emulsions. Lab Chip. Oct. 2008; 8(10):1632-9.
Hsu et al., Self-assembled shells composed of colloidal particles: fabrication and characterization. Langmuir. 2005;21:2963-70. Published on web Feb. 23, 2005.
Hug et al. Measurement of the number of molecules of a single mRNA species in a complex mRNA preparation. J Theor Biol. Apr. 21, 2003; 221(4):615-24.
Hung et al., Controlled Droplet Fusion in Microfluidic Devices. MicroTAS. Malmo, Sweden. Sep. 26-30, 2004. 3 pages.
Hung et al., Optimization of Droplet Generation by controlling PDMS Surface Hydrophobicity. 2004 ASME International Mechanical Engineering Congress and RD&D Expo. Anaheim, CA. Nov. 13-19, 2004. 2 pages.
Jang et al., Controllable delivery of non-viral DNA from porous scaffolds. J Control Release. Jan. 9, 2003;86(1):157-68.
Jo et al, Encapsulation of Bovine Serum Albumin in Temperature-Programmed "Shell-in-Shell" Structures. Macromol Rapid Commun 2003;24:957-62. Month not cited on publication.
Jogun et al., Rheology and microstructure of dense suspensions of plate-shaped colloidal particles. J. Rheol. Jul./Aug. 1999;43:847-71.
Kanouni et al., Preparation of a stable double emulsion (W1/O/W2): role of the interfacial films on the stability of the system. Adv Colloid Interface Sci. Dec. 2, 2002;99(3):229-54.

(56) References Cited

OTHER PUBLICATIONS

Kawakatsu et al., Production of W/O/W emulsions and S/O/W pectin microcapsules by microchannel emulsification. Colloids and Surfaces. Jan. 2001;189:257-64.
Kim et al., Albumin loaded microsphere of amphiphilic poly(ethylene glycol)/poly(α-ester) multiblock copolymer. Eu. J. Pharm. Sci. 2004;23:245-51. Available online Sep. 27, 2004.
Kim et al., Colloidal assembly route for responsive colloidsomes with tunable permeability. Nano Lett. 2007;7:2876-80. Published on web Aug. 3, 2007.
Kim et al., Comparative study on sustained release of human growth hormone from semi-crystalline poly(L-lactic acid) and amorphous poly(D,L-lactic-co-glycolic acid) microspheres: morphological effect on protein release. J Control Release. Jul. 23, 2004;98(1):115-25.
Kim et al., Double-emulsion drops with ultra-thin shells for capsule templates. Lab Chip. Sep. 21, 2011;11(18):3162-6. Epub Aug. 2, 2011.
Kim et al., Fabrication of monodisperse gel shells and functional microgels in microfluidic devices. Angew Chem Int Ed. 2007;46:1819-22. Month not cited on publication.
Kim et al., Monodisperse nonspherical colloid materials with well-defined structures. Presentation. Sep. 16, 2005. 5 pages.
Kim et al., Synthesis of nonspherical colloidal particles with anisotropic properties. JACS. 2006;128:14374-77. Published on web Oct. 18, 2006.
Kim et al., Uniform nonspherical colloidal particles engineered by geometrically tunable gradient of crosslink density. 80th ACS Colloid Surf. Sci. Symp. Jun. 20, 2006. 23 pages.
Kim et al., Uniform nonspherical colloidal particles with tunable shapes. Adv. Mater. 2007;19:Sep. 2005. Month not cited on publication.
Koo et al., A snowman-like array of colloidal dimers for antireflecting surfaces. Adv Mater. Feb. 3, 2004;16(3):274-77.
Kumar et al., Biodegradable block copolymers. Adv Drug Deliv Rev. Dec. 3, 2001;53(1):23-44.
Lamprecht et al., pH-sensitive microsphere delivery increases oral bioavailability of calcitonin. J Control Release. Jul. 23, 2004;98(1):1-9.
Landfester et al. Preparation of Polymer Particles in Nonaqueous Direct and Inverse Miniemulsions. Macromolecules. Mar. 11, 2000;33(7):2370-2376.
Landfester et al., Formulation and Stability Mechanisms of Polymerizable Miniemulsions. Macromolecules. 1999;32:5222-5228. Published on web Jul. 22, 1999.
Leary et al., Application of Advanced Cytometric and Molecular Technologies to Minimal Residual Disease Monitoring. In: In-Vitro Diagnostic Instrumentation. Gerald E. Cohn, Ed. Proceedings of SPIE. 2000;3913:36-44. Month not cited on publication.
Lee et al., Double emulsion-templated nanoparticle colloidosomes with selective permeability. Adv Mater. 2008;20:3498-503. Month not cited on publication.
Lee et al., Effective Formation of Silicone-in-Fluorocarbon-in-Water Double Emulsions: Studies on Droplet Morphology and Stability. Journal of Dispersion Science and Technology. 2002;23(4):491-7. Month not cited on publication.
Lee et al., Nonspherical colloidosomes with multiple compartments from double emulsions. Small. Sep. 2009;5(17):1932-5.
Lee et al., Preparation of Silica Particles Encapsulating Retinol Using O/W/O Multiple Emulsions. J Colloid Interface Sci. Aug. 1, 2001;240(1):83-89.
Lemoff et al., An AC Magnetohydrodynamic Microfluidic Switch for Micro Total Analysis Systems. Biomedical Microdevices. 2003;5(1):55-60. Month not cited on publication.
Li et al., PEGylated PLGA nanoparticles as protein carriers: synthesis, preparation and biodistribution in rats. Journal of Controlled Release. 2001;71:203-211. Month not cited on publication.
Lin et al., Ultrathin cross-linked nanoparticle membranes. JACS. 2003;125:12690-91. Published on web Sep. 27, 2003.
Link et al., Geometrically mediated breakup of drops in microfluidic devices. Phys Rev Lett. Feb. 6, 2004;92(5):054503. Epub Feb. 6, 2004. 4 pages.
Lopez-Herrera et al., Coaxial jets generated from electrified Taylor cones. Scaling laws. Aerosol Science. 2003:34:535-52. Month not cited on publication.
Lopez-Herrera et al., One-Dimensional Simulation of the Breakup of Capillary Jets of Conducting Liquids. Application to E.H.D. Spraying. J Aerosol Sci. 1999;30(7):895-912. Month not cited on publication.
Lopez-Herrera et al., The electrospraying of viscous and non-viscous semi-insulating liquids. Scalilng laws. Bulletin of the American Physical Society Nov. 1995;40:2041. Abstract JB 7.
Lorenceau et al., Generation of polymerosomes from double-emulsions. Langmuir. Sep. 27, 2005;21(20):9183-6.
Loscertales et al., Micro/nano encapsulation via electrified coaxial liquid jets. Science. Mar. 1, 2002;295(5560):1695-8.
Lundstrom et al., Breakthrough in cancer therapy: Encapsulation of drugs and viruses. www.currentdrugdiscovery.com. Nov. 19-23, 2002.
Ly et al., Effect of Alcohols on Lipid Bilayer Rigidity, Stability, and Area/Molecule (in collaboration with David Block and Roland Faller). Available at http://www.chms.ucdavis.edu/research/web/longo/micromanipulation.html. Last accessed Oct. 10, 2012.
Magdassi et al., Formation of water/oil/water multiple emulsions with solid oil phase. J Coll Interface Sci. Dec. 1987;120(2):537-9.
Manoharan et al., Dense packing and symmetry in small clusters of microspheres. Science. Jul. 25, 2003;301:483-87.
Marques et al., Porous Flow within Concentric Cylinders. Bulletin of the American Physical Society Division of Fluid Dynamics. Nov. 1996;41:1768. Available at http://flux.aps.org/meetings/YR9596/BAPSDFD96/abs/G1070001.html (downloaded Oct. 11, 2006) 2 pages.
Mazutis et al., Selective droplet coalescence using microfluidic systems. Lab Chip. Apr. 24, 2012; 12(10):1800-6.
Melin et al., A liquid-triggered liquid microvalve for on-chip flow control. Sensors and Actuators B. May 2004;100(3):463-68.
Mock et al., Synthesis of anisotropic nanoparticles by seeded emulsion polymerization. Langmuir. Apr. 25, 2006;22(9):4037-43. Published on web Mar. 31, 2006.
Naka et al., Control of crystal nucleation and growth of calcium carbonate bysynthetic substrates. Chem Mater 2001;13:3245-59.
Nakano et al., Single-molecule PCR using water-in-oil emulsion. J Biotechnol. Apr. 24, 2003;102(2):117-24.
Nie et al., Polymer particles with various shapes and morphologies produced in continuous microfluidic reactors. J Am Chem Soc. Jun. 8, 2005;127(22):8058-63.
Nihant et al., Polylactide microparticles prepared by double emulsion/evaporation technique. I. Effect of primary emulsion stability. Pharm Res. Oct. 1994;11(10):1479-84.
Nikolaides et al., Two Dimensional Crystallisation on Curved Surfaces. MRS Fall 2000 Meeting. Boston, MA. Nov. 27, 2000. Abstract #41061.
Nisisako et al., Controlled formulation of monodisperse double emulsions in a multiple-phase microfluidic system. Soft Matter. 2005;1:23-7. Month not cited on publication.
Nisisako, Microstructured Devices for Preparing Controlled Multiple Emulsions. Chem Eng Technol. 2008;31:1091-8. Month not cited on publication.
Nof et al., Drug-releasing scaffolds fabricated from drug-loaded microspheres. J Biomed Mater Res. Feb. 2002;59(2):349-56.
Oh et al., Distribution of macropores in silica particles prepared by using multiple emulsions. J Colloid Interface Sci. Oct. 1, 2002;254(1):79-86.
Okubo et al., Micron-sized, monodisperse, snowman/confetti-shaped polymer particles by seeded dispersion polymerization. Colloid Polym. Sci. 2005;283:1041-45. Published online Apr. 2, 2005.
Okushima et al., Controlled production of monodisperse double emulsions by two-step droplet breakup in microfluidic devices. Langmuir. Nov. 9, 2004;20(23):9905-8.
Ouellette, A New Wave of Microfluidic Device. The Industrial Physicist. Aug./Sep. 2003:14-7.

(56) References Cited

OTHER PUBLICATIONS

Pannacci et al., Equilibrium and nonequilibrium states in microfluidic double emulsions. Phys Rev Lett. Oct. 17, 2008;101(16):164502. Epub Oct. 14, 2008. 4 pages.
Perez et al., Poly(lactic acid)-poly(ethylene glycol) nanoparticles as new carriers for the delivery of plasmid DNA. Journal of Controlled Release. 2001;75:211-224. Month not cited on publication.
Piemi et al., Transdermal delivery of glucose through hairless rat skin in vitro: effect of multiple and simple emulsions. Int J Pharm. 1998; 171:207-15. Month not cited on publication.
Priest et al., Generation of monodisperse gel emulsions in a microfluidic device. App Phys Lett. 2006;88:024106. 3 pages. Published online Jan. 12, 2006.
Quevedo et al., Interfacial polymerization within a simplified microfluidic device: capturing capsules. J Am Chem Soc. Aug. 3, 2005;127(30):10498-9.
Raghuraman et al., Emulsion liquid membranes for wastewater treatment: equilibrium models for some typical metal-extractant systems. Environ Sci Technol. Jun. 1, 1994;28(6):1090-8.
Reculusa et al., Synthesis of daisy-shaped and multipod-like silica/polystyrene nanocomposites. Nano Lett. 2004;4:1677-82. Published on web Jul. 14, 2004.
Roh et al., Biphasic janus particles with nanoscale anisotropy. Nature Med. Oct. 2005;4:759-63.
Rojas et al., Induction of instability in water-in-oil-in-water double emulsions by freeze-thaw cycling. Langmuir. Jun. 19, 2007;23(13):6911-7. Epub May 24, 2007.
Rojas et al., Temperature-induced protein release from water-in-oil-in-water double emulsions. Langmuir. Jul. 15, 2008;24(14):7154-60. Epub Jun. 11, 2008.
Schubert et al., Designer Capsules. Nat Med. Dec. 2002;8:1362.
Seo et al., Microfluidic consecutive flow-focusing droplet generators. Soft Matter. 2007;3:986-92. Published online May 29, 2007.
Sheu et al., Phase separation in polystyrene latex interpenetrating polymer networks. J. Poly. Sci. A. Poly. Chem. 1990;28:629-51. Month not cited on publication.
Shum et al., Abstract: P9.00001 : Microfluidic Fabrication of Bio-compatible Vesicles by Self-assembly in Double Emulsions. 2008 APS March Meeting. Mar. 10-14, 2008. New Orleans, LA. Submitted Nov. 26, 2007. Presented Mar. 12, 2008. Abstract Only.
Shum et al., Double emulsion templated monodisperse phospholipid vesicles. Langmuir. Aug. 5, 2008;24(15):7651-3. Epub Jul. 10, 2008.
Shum et al., Microfluidic Fabrication of Bio-compatible Vesicles Using Double Emulsion Drops as Templates. APS March Meeting 2008. Presented Mar. 12, 2008. 16 pages.
Shum et al., Microfluidic fabrication of monodisperse biocompatible and biodegradable polymersomes with controlled permeability. J Am Chem Soc. Jul. 23, 2008;130(29):9543-9. Epub Jun. 25, 2008.
Shum et al., Template-Directed Assembly of Amphiphiles in Controlled Emulsions by Microfluidics. 82$^{nd}$ ACS Colloid & Surface Science Symposium. Jun. 15-18, 2008. Presented Jun. 16, 2008. Abstract Only.
Silva-Cunha et al., W/O/W multiple emulsions of insulin containing a protease inhibitor and an absorption enhancer: biological activity after oral administration to normal and diabetic rats. Int J Pharmaceutics. 1998;169:33-44. Month not cited on publication.
Sim et al. The shape of a step structure as a design aspect to control droplet generation in microfluidics. J Micromech Microeng. Feb. 9, 2010;20:035010. 6 pages.
Skjeltorp et al., Preparation of nonspherical, monodisperse polymer particles and their self-organization. J. Colloid Interf. Sci. Oct. 1986;113:577-82.
Sohn et al., Capacitance cytometry: measuring biological cells one by one. Proc Natl Acad Sci U S A. Sep. 26, 2000;97(20):10687-90.
Song et al., A microfluidic system for controlling reaction networks in time. Angew Chem Int Ed Engl. Feb. 17, 2003;42(7):768-72.
Sun et al., Microfluidic melt emulsification for encapsulation and release of actives. ACS Appl Mater Interfaces. Dec. 2010;2(12):3411-6. Epub Nov. 17, 2010.
Takeuchi et al., An Axisymmetric Flow-Focusing Microfluidic Device. Adv Mater. Apr. 18, 2005;17:1067-72.
Tan et al., Controlled Fission of Droplet Emulsions in Bifurcating Microfluidic Channel. Boston. Transducers. 2003. 4 pages. Month not cited on publication.
Tan et al., Design of microfluidic channel geometries for the control of droplet volume, chemical concentration, and sorting. Lab Chip. Aug. 2004;4(4):292-8. Epub Jul. 1, 2004.
Tan et al., Microfluidic Liposome Generation from Monodisperse Droplet Emulsion—Towards the Realization of Artificial Cells. Summer Bioengineering Conference Jun. 25-9, 2003. Key Biscayne, Florida. 2 pages.
Tan, Monodisperse Droplet Emulsions in Co-Flow Microfluidic Channels. Lake Tahoe. Micro TAS. 2003. 2 pages.
Tawfik et al., Man-made cell-like compartments for molecular evolution. Nat Biotechnol. Jul. 1998;16(7):652-6.
Terray et al., Fabrication of linear colloidal structures for microfluidic applications. App Phys Lett. Aug. 26, 2002;81:1555-7.
Terray et al., Microfluidic control using colloidal devices. Science. Jun. 7, 2002;296(5574):1841-4.
Thomas et al., Using a liquid emulsion membrane system for the encapsulation of organic and inorganic substrates within inorganic microcapsules. Chem Commun (Camb). May 21, 2002;(10):1072-3.
Thorsen et al., Dynamic pattern formation in a vesicle-generating microfluidic device. Phys Rev Lett. Apr. 30, 2001;86(18):4163-6.
Ulrich, Chapter 1. General Introduction. Chem. Tech. Carbodiimides. 2007:1-7. Month not cited on publication.
Umbanhowar et al., Monodisperse Emulsion Generation via Drop Break Off in a Coflowing Stream. Langmuir. 2000;16:347-51. Published on web Oct. 14, 1999.
Utada et al., Monodisperse double emulsions generated from a microcapillary device. Science. Apr. 22, 2005;308(5721):537-41.
Van Blaaderen, Colloidal molecules and beyond. Science. Jul. 25, 2003;301:470-71.
Van Blaaderen, Colloids get complex. Nature. Feb. 2006;439:545-46.
Velev et al., Assembly of latex particles by using emulsion droplets. 3. Reverse (water in oil) system. Langmuir. 1997;13:1856-59. Month not cited on publication.
Velev et al., Assembly of latex particles using emulsion droplets as templates. 1. Microstructured hollow spheres. Langmuir. 1996;12:2374-84. Month not cited on publication.
Velev et al., Assembly of latex particles using emulsion droplets as templates. 2. Ball-like and composite aggregates. Langmuir. 1996;12:2385-91. Month not cited on publication.
Wang, Fabrication of a Toroidal Structure of Polymer Particle by Phase Separation with One Dimensional Axial Flow in Microchannel . . . 82$^{nd}$ ACS Colloid & Surface Science Symposium. Jun. 15-18, 2008. Presented Jun. 17, 2008. Abstract Only.
Weitz, Nonspherical engineering of polymer colloids. Web Page. Exp. Soft Condensed Matter Group. Last updated Nov. 10, 2005. 1 page.
Weitz, Packing in the spheres. Science. Feb. 13, 2004;303:968-969.
Wolff et al., Integrating advanced functionality in a microfabricated high-throughput fluorescent-activated cell sorter. Lab Chip. Feb. 2003;3(1):22-7. Epub Jan. 23, 2003.
Xu et al., Generation of Monodisperse Particles by Using Microfluidics: Control over Size, Shape and Composition. Angew Chem Int Ed. 2004;43:2-5. Month not cited on publication.
Yamaguchi et al., Insulin-loaded biodegradable PLGA microcapsules: initial burst release controlled by hydrophilic additives. J Control Release. Jun. 17, 2002;81(3):235-49.
Yin et al., Template-assisted self-assembly: a practical route to complex aggregates of monodispersed colloids with well-defined sizes, shapes, and structures. JACS. 2001;123:8718-29. Published on web Aug. 15, 2001.
Yoon et al., Abstract: X8.00007 : Fabrication of phospholipid vesicles from double emulsions in microfluidics. 2008 APS March Meeting. Mar. 10-14, 2008. New Orleans, LA. Submitted Nov. 26, 2007. Presented Mar. 14, 2008. Abstract Only.
Yoon et al., Fabrication of giant phospholipid vesicles from double emulsions in microfluidics. APS March Meeting 2008. Presented Mar. 14, 2008. 11 pages.

(56) References Cited

OTHER PUBLICATIONS

Zhang et al., A Simple Statistical Parameter for Use in Evaluation and Validation of High Throughput Screening Assays. J Biomol Screen. 1999;4(2):67-73. Month not cited on publication.
Zhao et al., Enhanced encapsulation of actives in self-sealing microcapsules by precipitation in capsule shells. Langmuir. Dec. 6, 2011;27(23):13988-91. Epub Oct. 26, 2011.
Zhao, Preparation of hemoglobin-loaded nano-sized particles with porous structure as oxygen carriers. Biomaterials. 2007;28:1414-1422. Available online Nov. 28, 2006.
Zheng et al., A microfluidic approach for screening submicroliter volumes against multiple reagents by using preformed arrays of nanoliter plugs in a three-phase liquid/liquid/gas flow. Angew Chem Int Ed Engl. Apr. 22, 2005;44(17):2520-3.
Zimmermann et al., Microscale production of hybridomas by hypo-osmolar electrofusion. Hum Antibodies Hybridomas. Jan. 1992;3(1):14-8.

* cited by examiner

CONTROL OF EMULSIONS, INCLUDING MULTIPLE EMULSIONS

RELATED APPLICATIONS

This application is a continuation of U.S. patent application Ser. No. 13/477,636, filed May 22, 2012, entitled "Control of Emulsions, Including Multiple Emulsions," by Rotem, et al., which claims the benefit of U.S. Provisional Patent Application Ser. No. 61/489,211, filed May 23, 2011, entitled "Control of Emulsions, Including Multiple Emulsions," by Rotem, et al., each incorporated herein by reference.

FIELD OF INVENTION

The present invention generally relates to emulsions, and more particularly, to double and other multiple emulsions.

BACKGROUND

An emulsion is a fluidic state which exists when a first fluid is dispersed in a second fluid that is typically immiscible with the first fluid. Examples of common emulsions are oil-in-water and water-in-oil emulsions. Multiple emulsions are emulsions that are formed with more than two fluids, or two or more fluids arranged in a more complex manner than a typical two-fluid emulsion. For example, a multiple emulsion may be oil-in-water-in-oil ("o/w/o"), or water-in-oil-in-water ("w/o/w"). Multiple emulsions are of particular interest because of current and potential applications in fields such as pharmaceutical delivery, paints, inks and coatings, food and beverage, chemical separations, and health and beauty aids.

Typically, multiple emulsions of a droplet inside another droplet are made using a two-stage emulsification technique, such as by applying shear forces or emulsification through mixing to reduce the size of droplets formed during the emulsification process. Other methods such as membrane emulsification techniques using, for example, a porous glass membrane, have also been used to produce water-in-oil-in-water emulsions. Microfluidic techniques have also been used to produce droplets inside of droplets using a procedure including two or more steps. For example, see International Patent Application No. PCT/US2004/010903, filed Apr. 9, 2004, entitled "Formation and Control of Fluidic Species," by Link, et al., published as WO 2004/091763 on Oct. 28, 2004; or International Patent Application No. PCT/US03/20542, filed Jun. 30, 2003, entitled "Method and Apparatus for Fluid Dispersion," by Stone, et al., published as WO 2004/002627 on Jan. 8, 2004, each of which is incorporated herein by reference.

SUMMARY OF THE INVENTION

The present invention generally relates to emulsions, and more particularly, to double and other multiple emulsions. The subject matter of the present invention involves, in some cases, interrelated products, alternative solutions to a particular problem, and/or a plurality of different uses of one or more systems and/or articles.

In one aspect, the present invention is generally directed to a microfluidic device. In one set of embodiments, the microfluidic device includes a first junction of microfluidic channels comprising at least first, second, and third microfluidic channels in fluidic communication. The first junction may be in fluid communication at an interface with a second junction of microfluidic channels comprising at least fourth, fifth, and sixth microfluidic channels in fluidic communication. In some cases, each of the first, second, and third microfluidic channels has a respective cross-sectional area at the first junction and each of the fourth, fifth, and sixth microfluidic channels has a respective cross-sectional area at the second junction, where the interface has a cross-sectional area smaller than the smallest cross-sectional areas of the fourth, fifth, and sixth microfluidic channels.

The microfluidic device, in another set of embodiments, includes a junction of microfluidic channels comprising at least first, second, third, fourth, fifth, and sixth microfluidic channels in fluid communication. In some embodiments, each of the first, second, third, fourth, fifth, and sixth channels has a cross-sectional area at the junction, where the second and third cross-sectional areas are substantially the same, the fourth and fifth cross-sectional areas are substantially the same, and the cross-sectional areas of the first, second, and third channels at the junction are each smaller than the smallest cross-sectional areas of the fourth, fifth, and sixth channels at the junction.

In another aspect, the present invention is generally directed to a method of creating a double or other multiple emulsion. According to one set of embodiments, the method includes an act of surrounding a first fluid with a second fluid while simultaneously passing the first and second fluids, through an interface between a first junction of microfluidic channels and a second junction of microfluidic channels, into a third fluid to surround the first and second fluids and produce a double emulsion droplet comprising a droplet of the first fluid surrounded by a droplet of the second fluid, contained within the third fluid.

In another set of embodiments, the method includes an act of creating a double emulsion at a common junction of microfluidic channels, where each of the microfluidic channels at the common junction have substantially the same hydrophobicity.

In another aspect, the present invention encompasses methods of making one or more of the embodiments described herein, for example, devices for creating double and other multiple emulsions. In still another aspect, the present invention encompasses methods of using one or more of the embodiments described herein, for example, devices for creating double and other multiple emulsions.

Other advantages and novel features of the present invention will become apparent from the following detailed description of various non-limiting embodiments of the invention when considered in conjunction with the accompanying figures. In cases where the present specification and a document incorporated by reference include conflicting and/or inconsistent disclosure, the present specification shall control. If two or more documents incorporated by reference include conflicting and/or inconsistent disclosure with respect to each other, then the document having the later effective date shall control.

BRIEF DESCRIPTION OF THE DRAWINGS

Non-limiting embodiments of the present invention will be described by way of example with reference to the accompanying figures, which are schematic and are not intended to be drawn to scale. In the figures, each identical or nearly identical component illustrated is typically represented by a single numeral. For purposes of clarity, not every component is labeled in every figure, nor is every component of each embodiment of the invention shown where illustration is not necessary to allow those of ordinary skill in the art to understand the invention. In the figures.

DETAILED DESCRIPTION

The present invention generally relates to emulsions, and more particularly, to double and other multiple emulsions. Certain aspects of the present invention are generally directed to the creation of double emulsions and other multiple emulsions at a common junction of microfluidic channels. In some cases, the microfluidic channels at the common junction may have substantially the same hydrophobicity. In one set of embodiments, a device may include a common junction of six or more channels, where a first fluid flows through one channel, a second fluid flows through two channels, and a third or carrying fluid flows through two more channels, such that a double emulsion of a first droplet of the first fluid, contained in a second droplet of the second fluid, contained by the carrying fluid, flows away from the common junction through a sixth channel. Other aspects of the invention are generally directed to methods of making and using such systems, kits involving such systems, emulsions created using such systems, or the like.

Figure 1A:
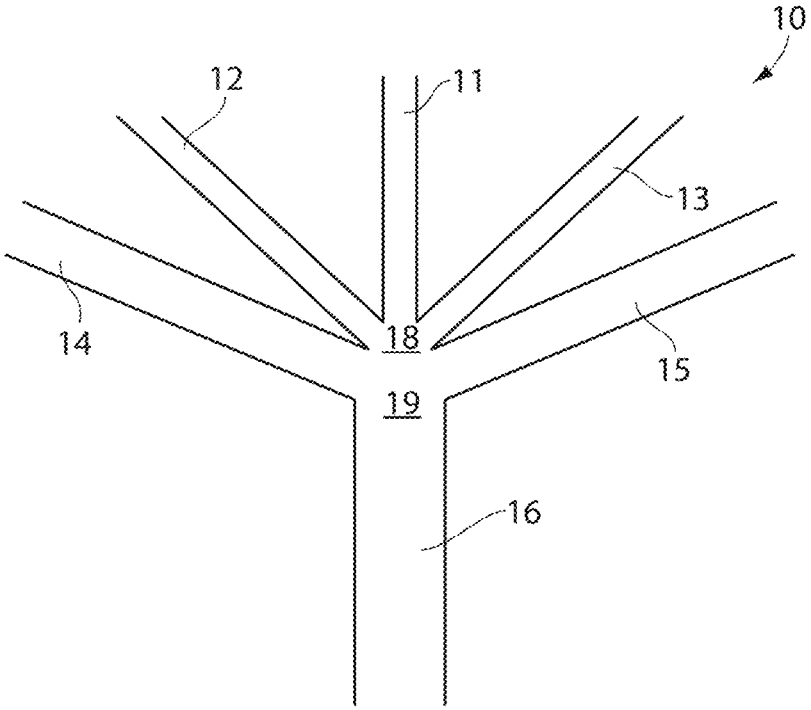
FIGS. 1A-1B illustrate various channel configurations, according to certain embodiments of the invention.

One aspect of the present invention is generally directed to systems and methods for creating double emulsions and other multiple emulsions at a common junction of microfluidic channels. One non-limiting example is illustrated in FIG. 1A with microfluidic system 10. In this example, microfluidic system 10 includes first channel 11, second channel 12, third channel 13, fourth channel 14, fifth channel 15, and sixth channel 16. First channel 11, second channel 12, and third channel 13 meet at first junction portion 18. Second channel 12 and third channel 13 may meet at any suitable angle with first channel 11. For example second channel 12 and third channel 13 may be at a relatively sharp or relatively shallow angle, or they may even be at 180° from each other. Second channel 12 and third channel 13 may meet first channel 11, for example, at an angle of less than 90° or greater than 90°. In addition, second channel 12 and third channel 13 may be at the same, or different angles, with respect to first channel 11, i.e., second channel 12 and third channel 13 may be symmetrically or non symmetrically arranged about first channel 11. Furthermore, as discussed below, in other embodiments, other numbers of channels may be present.

Also shown in FIG. 1A are fourth channel 14, fifth channel 15, and sixth channel 16, which meet at second junction portion 19. Like above, fourth channel 14 and fifth channel 15 may meet at any suitable angle with sixth channel 16. For example fourth channel 14 and fifth channel 15 may be at a relatively sharp or relatively shallow angle, or they may even be at 180° from each other. Fourth channel 14 and fifth channel 15 may meet first channel 11, for example, at an angle of less than 90° or greater than 90°. In addition, fourth channel 14 and fifth channel 15 may be at the same, or different angles, with respect to sixth channel 16, i.e., fourth channel 14 and fifth channel 15 may be symmetrically or non symmetrically arranged about sixth channel 16. In other embodiments, other numbers of channels may be present. As shown in FIG. 1, first channel 11 and sixth channel 16 are positioned to be substantially collinear with each other, i.e., a central axis defined by first channel 11 and a central axis defined by sixth channel 16 essentially fall on the same line. In other embodiments, however, first channel 11 and sixth channel 16 need not be collinear.

Figure 1B:
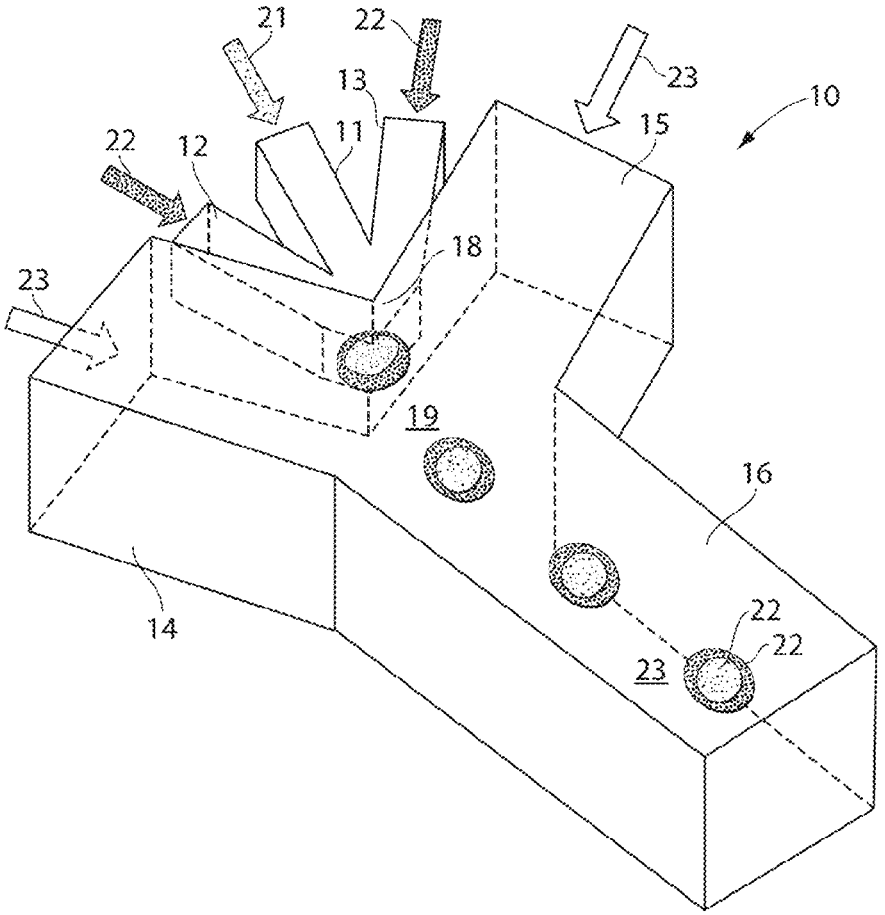

The intersection of first junction portion 18 and second junction portion 19 is now discussed with reference to FIG. 1B. As can be seen in this figure, first junction portion 18 and second junction portion 19 are in fluid communication via interface 20. In this figure, interface 20 has substantially the same cross-sectional area as first channel 11, but is smaller than the cross-sectional area as sixth channel 16, although in other embodiments, interface 20 may be smaller or larger than the cross-sectional area of first channel 11. In addition, interface 20 may be square or rectangular as shown in FIG. 1B, or have other shapes such as those described herein. Interface 20 is positioned to be substantially centered with respect to sixth channel 16, e.g., the center point or geometric median of interface 20 is substantially located on an axis defined by sixth channel 16.

In this system, various fluids enter through first channel 11, second channel 12, third channel 13, fourth channel 14, and fifth channel 15, and leaves through sixth channel 16. Fluids entering first junction portion 18 pass through interface 20 into second junction portion 19. Accordingly, first junction portion 18 and second junction portion 19 are in fluid communication with each other, and may be considered to be part of a larger intersection of first channel 11, second channel 12, third channel 13, fourth channel 14, fifth channel 15, and sixth channel 16.

One example of the use of microfluidic system 10 is now described with reference to FIG. 1B. A first (inner) fluid 21 enters through first channel 11 while a second (outer) fluid 22 enters through second channel 12 and third channel 13. The first and second fluids may be miscible or immiscible. At first junction portion 18, the second fluid substantially surrounds the first fluid as the first and second fluids pass through interface 20 into second junction portion 19. A third (carrying) fluid 23 also enters second junction portion 19 through fourth channel 14 and fifth channel 15. Upon entering second junction portion 19, the third fluid surrounds the second fluid surrounding the first fluid. The first and second fluids entering second junction portion 19 through interface 20 are then pinched off to form an isolated droplet contained within the third fluid, thereby forming a double emulsion droplet 25 of first fluid 21, contained within a droplet of second fluid 22, contained within carrying fluid 23, which exits the junction through sixth channel 16.

Accordingly, various aspects of the present invention are generally directed to systems and methods of creating double emulsions and other multiple emulsions at a common junction of microfluidic channels (which may include two or more portions adjacent or fluidically communicative with each other, e.g., as described above). A "multiple emulsion," as used herein, describes larger droplets that contain one or more smaller droplets therein. In a double emulsion, the larger droplets may, in turn, be contained within another fluid, which may be the same or different than the fluid within the smaller droplet. In certain embodiments, larger degrees of nesting within the multiple emulsion are possible. For example, an emulsion may contain droplets containing smaller droplets therein, where at least some of the smaller droplets contain even smaller droplets therein, etc. Multiple emulsions can be useful for encapsulating species such as pharmaceutical agents, cells, chemicals, or the like. As described below, multiple emulsions can be formed in certain embodiments with generally precise repeatability.

Fields in which emulsions or multiple emulsions may prove useful include, for example, food, beverage, health and beauty aids, paints and coatings, and drugs and drug delivery. For instance, a precise quantity of a drug, pharmaceutical, or other agent can be contained within an emulsion, or in some instances, cells can be contained within a droplet, and the cells can be stored and/or delivered. Other species that can be stored and/or delivered include, for example, biochemical species such as nucleic acids such as siRNA, RNAi and DNA, proteins, peptides, or enzymes, or the like. Additional species that can be incorporated within an emulsion of the invention include, but are not limited to, nanoparticles, quantum dots, fragrances, proteins, indicators, dyes, fluorescent species, chemicals, drugs, or the like. An emulsion can also serve as a reaction vessel in certain cases, such as for controlling chemical reactions, or for in vitro transcription and translation, e.g., for directed evolution technology.

In one set of embodiments of the present invention, a double emulsion is produced, i.e., a carrying fluid, containing a second fluidic droplet, which in turn contains a first fluidic droplet therein. In some cases, the carrying fluid and the first fluid may be the same. The fluids may be of varying miscibilities, e.g., due to differences in hydrophobicity. For example, the first fluid may be water soluble, the second fluid oil soluble, and the carrying fluid water soluble. This arrangement is often referred to as a w/o/w multiple emulsion ("water/oil/water"). Another double emulsion may include a first fluid that is oil soluble, a second fluid that is water soluble, and a carrying fluid that is oil soluble. This type of double emulsion is often referred to as an o/w/o double emulsion ("oil/water/oil"). It should be noted that the term "oil" in the above terminology merely refers to a fluid that is generally more hydrophobic and not miscible in water, as is known in the art. Thus, the oil may be a hydrocarbon in some embodiments, but in other embodiments, the oil may comprise other hydrophobic fluids. It should also be understood that the water need not be pure; it may be an aqueous solution, for example, a buffer solution, a solution containing a dissolved salt, or the like.

More specifically, as used herein, two fluids are immiscible, or not miscible, with each other when one is not soluble in the other to a level of at least 10% by weight at the temperature and under the conditions at which the emulsion is produced. For instance, two fluids may be selected to be immiscible within the time frame of the formation of the fluidic droplets. In some embodiments, the fluids used to form a double emulsion or other multiple emulsion may the same, or different. For example, in some cases, two or more fluids may be used to create a double emulsion or other multiple emulsion, and in certain instances, some or all of these fluids may be immiscible. In some embodiments, two fluids used to form a double emulsion or other multiple emulsion are compatible, or miscible, while a middle fluid contained between the two fluids is incompatible or immiscible with these two fluids. In other embodiments, however, all three fluids may be mutually immiscible, and in certain cases, all of the fluids do not all necessarily have to be water soluble.

More than two fluids may be used in other embodiments of the invention. Accordingly, certain embodiments of the present invention are generally directed to multiple emulsions, which includes larger fluidic droplets that contain one or more smaller droplets therein which, in some cases, can contain even smaller droplets therein, etc. Any number of nested fluids can be produced, and accordingly, additional third, fourth, fifth, sixth, etc. fluids may be added in some embodiments of the invention to produce increasingly complex droplets within droplets to define various multiple emulsions. It should be understood that not all of these fluids necessarily need to be distinguishable; for example, a triple emulsion containing oil/water/oil/water or water/oil/water/oil may be prepared, where the two oil phases have the same composition and/or the two water phases have the same composition.

As mentioned, certain aspects of the present invention are generally directed to certain arrangements of channels that meet or intersect at a common junction, which may include various junction portions, each of which is defined by the intersection of two or more channels. Typically, at the junction, the channels connect or intersect at the same location and are in fluid communication with each other within the junction. The channels may be used, for example, to produce double emulsions or other multiple emulsions, e.g., at a common junction of microfluidic channels. For example, using such an arrangement, a first fluid may be surrounded with a second fluid while the first and second fluids are passed through an interface into a third fluid, which surrounds the first and second fluids to produce a double emulsion comprising a droplet of the first fluid surrounded by a droplet of the second fluid, contained within the third fluid.

As one particular non-limiting example, there may be six channels each meeting at a common junction as described above, although in other embodiments, there may be more or fewer channels present at the common junction. In some embodiments, there may be at least three entering channels, respectively containing first, second, and third fluids, each meeting at a common junction. However, in other embodiments, there may be two or more channels containing one or more fluids into the common junction. As non-limiting examples, in one embodiment, there may be a first channel containing a first fluid, second and third channels containing a second fluid, and a fourth channel containing a third fluid; in another embodiment, there may be first channel containing a first fluid, second and third channels containing a second fluid, and fourth and fifth channels containing a third fluid; in yet another embodiment, there may be first and second channels containing a first fluid, third and fourth channels containing a second fluid, and fifth and sixth channels containing a third fluid; and in still another embodiment, there may be a first channel containing a first fluid, second and third channels containing a second fluid, fourth and fifth channels containing a third fluid, and sixth and seventh channels containing a fourth fluid.

The common junction can also have one or more outlet channels for carrying a fluid away from the common junction. Typically, the outlet channel carries an emulsion of the fluids entering the common junction, e.g., as a single emulsion, or as a double or other multiple emulsion.

As mentioned, in some embodiments, the common junction may include one or more junction portions. Each junction portion is defined by at least two channels intersecting therein. For example, as discussed above with respect to FIG. 1B, first junction portion 18 is defined by the intersection of three channels (first channel 11, second channel 12, and third channel 13), while second junction portion 19 is defined by the intersection of three different channels (fourth channel 14, fifth channel 15, and sixth channel 16), although first junction portion 18 and second junction portion 19 are adjacent to each other, e.g., via an interface, thereby defining a junction in which each of first channel 11, second channel 12, third channel 13, fourth channel 14, fifth channel 15, and sixth channel 16 intersects.

In some embodiments, the channels defining a first junction portion may be smaller than the channels defining the second junction portion. For instance, the largest cross-sectional area of the channels (e.g., defined in a direction perpendicular to fluid flow within the channel) defining the first junction portion may be smaller than the smallest cross-sectional area of the channels defining the second junction portion. In some embodiments, the largest cross-sectional area of the channels defining the first junction portion may be smaller than about 90%, smaller than about 80%, smaller than about 70%, smaller than about 60%, smaller than about 50%, smaller than about 40%, smaller than about 30%, smaller than about 20%, smaller than about 10%, or smaller than about 5% of the smallest cross-sectional area of the channels defining the second junction portion. In certain instances, this may be achieved in embodiments where the channels all have substantially the same heights (or widths), but different widths (or heights). In other embodiments, this may be achieved using channels having different heights and widths, different sizes, different shapes, different cross-sectional areas, etc.

Figure 4:
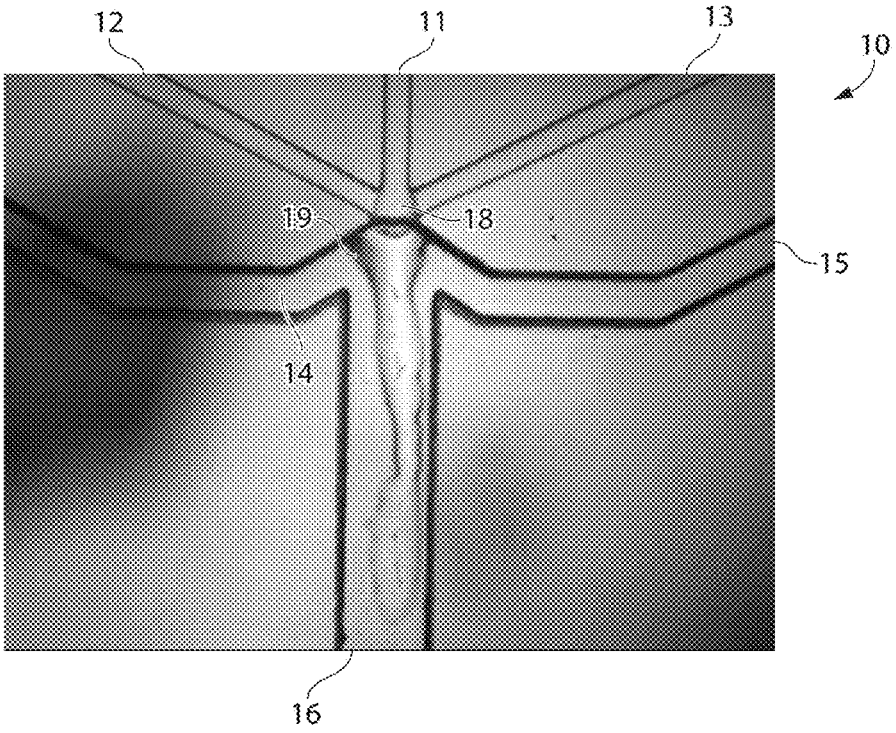
FIG. 4 illustrates a microfluidic device according to another embodiment of the invention.

As mentioned, the channels entering the junction or junction portions may be at any suitable angle with respect to each other, and the overall arrangement of channels about the junction may be symmetric or nonsymmetric. For example, the channels entering the common junction may exhibit bilateral symmetry, i.e., such that a plane exists that can cut the junction into two halves that are essentially mirror images of each other. In some embodiments, for example, the channels may be arranged such that some or all of them meet at angles of less than 90°. For example, in one arrangement, each of the input channels to the junction may be positioned such that the largest angle defined by them is 180° or less, or such that two input channels entering a common junction meet at an angle of less than 90°. In some cases, all of the input channels entering a common junction may meet such that every pair of adjacent input channels meets at an angle of less than 90°. In other cases, however, these angles may be greater than 90°, for example, as is shown in FIG. 4. The outlet channel, in some cases, may be positioned opposite one of the input channels, e.g., such that an axis defined by an output channel and an axis defined by one of the input channels are substantially parallel, or even substantially collinear in certain embodiments.

For example, referring now to FIG. 4, microfluidic system 10 in this figure includes first channel 11, second channel 12, third channel 13, fourth channel 14, fifth channel 15, and sixth channel 16. First channel 11, second channel 12, and third channel 13 meet at first junction portion 18, and Fourth channel 14, fifth channel 15, and sixth channel 16, which meet at second junction portion 19. Unlike in FIG. 1A, however, fourth channel 14 and fifth channel 15 each meet channel 11 in FIG. 4 at an angle greater than 90°.

The interface between junction portions within a junction can have any size and/or shape. For example, the interface may be square, rectangular, triangular, circular, oval, irregular, or the like. In some embodiments, the interface between a first junction portion and a second junction portion may be a difference in channel dimensions (e.g., height, width, shape etc.). For example, the interface between a first junction portion and a second junction portion may be an orifice or a constriction between the two portions, or the interface may have a size or a cross-sectional area that is the same size (or smaller) as the channels defining the first junction portion, and smaller than the channels defining the second junction portion. Thus, for example, the interface may be the same size as, or smaller than, the smaller of the first junction portion and the second junction portion. For instance, the interface may have a cross-sectional area that is less than about 90%, less than about 80%, less than about 70%, less than about 60%, less than about 50%, less than about 40%, less than about 30%, less than about 20%, less than about 10%, or less than about 5% of the smaller of the cross-sectional areas of the junction portions on either side of the interface. The interface may also be positioned to be aligned with one or more of the inlet or outlet channels. For example, in certain embodiments, the interface can be positioned such that a center point or geometric median of the interface is substantially located on the central axis of the outlet channel.

In some cases, the first junction portion may have a first cross-sectional area (e.g., defined by the channels forming the first junction portion), and the second junction portion may have a second cross-sectional area (e.g., defined by the channels forming the second junction portion), where the first cross-sectional area is smaller than the second cross-sectional area. For instance, the first cross-sectional area may be less than about 90%, less than about 80%, less than about 70%, less than about 60%, less than about 50%, less than about 40%, less than about 30%, less than about 20%, less than about 10%, or less than about 5% of the second cross-sectional area.

Figure 5:
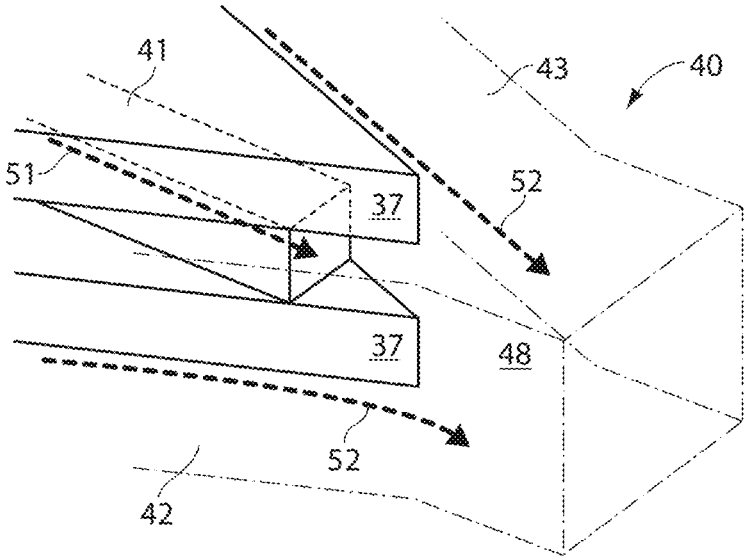
FIG. 5 illustrates a microfluidic device in yet another embodiment of the invention.

In some embodiments, there may be additional "lips" or other portions of the channel that prevent or at least reduce the formation of "dead zones," where fluid within the dead zones do not mix readily with other fluids, e.g., trapped due to eddies or the like that are caused by fluid flow within the common junction. An example of this may be seen in FIG. 5A in microfluidic system 40. In this figure, a first, inner fluid 51 enters through first channel 41 towards junction portion 48, as indicated by dotted lines. A second, outer fluid 52 flows towards junction portion 48 through second channel 42 and third channel 43, also indicated by dotted lines. At the intersection of first channel 41, second channel 42, and third channel 43, lip portions 37 above and below the entrance of first channel 41 into junction portion 48 block prevent the creation of "dead zones" where second fluid 52 may be trapped due to the flow of the first and second fluids into the junction portion. In this example, the lip portions are present as extensions of the walls of second channel 42 and third channel 43 into junction portion 48, although in other embodiments, the lip portions may have other shapes suitable for preventing or at least reducing the creation of "dead zones" of fluid within junction portion 48.

In certain aspects of the invention, each of the microfluidic channels at the common junction may have substantially the same hydrophobicity (although in other embodiments, various channels may have different hydrophobicities). For example, the walls forming the microfluidic channels may be substantially untreated, or treated with the same coating. Examples of systems and methods for coating microfluidic channels are discussed in detail below.

In some embodiments, the device may be constructed and arranged such that little or no "fouling" or deposition of material on the walls forming the channels of the devices occurs. For example, in some embodiments, a fluid, such as a fluid that becomes the innermost fluid of a multiple emulsion droplet, may contain a material that can deposit on the walls of the channel if the fluid comes into contact with the walls. Thus, by preventing contact of the fluid with the walls of the channel, before and/or after formation of the multiple emulsion droplet, the amount of fouling within the channels may be reduced or even eliminated.

For example, in one set of embodiments, in a common junction, a fluid flowing through a first channel (e.g., channel 11 in FIG. 1A) may enter the common junction and be surrounded by fluids entering through other channels (e.g., channels 12, 13, 14, 15 in FIG. 1A). Thus, due to the presence of the other fluids entering through other channels, the fluid within first junction 11 may not be able to contact the walls of the channels, and thus, species that are present within this fluid can not contact the walls of the channels and thereby deposit or foul on those walls.

The surrounding fluids may prevent this fluid from contacting the walls of the channel using a variety of techniques. For example, the positions of the incoming channels and/or the flow velocities of the fluids, may be used to surround the inner fluid. In certain cases, such control may be achieved without requiring any coating techniques such as those described herein. In other embodiments, however, the hydrophobicities of the various fluids may also be used, for example, as the fluids interact with the walls of the channels. For example, the channel walls may have a hydrophobicity that preferentially attracts a different fluid other than the inner fluid, such that the inner fluid is relatively repelled or unattracted by the walls. In some cases, a combination of these may be used. For example, a device may be constructed and arranged such that the inner fluid is prevented from contacting the walls of the channel by a combination of device geometry and interaction with the walls of the channel.

As discussed above, in some aspects, a monodisperse emulsion may be produced using such devices. The shape and/or size of the fluidic droplets can be determined, for example, by measuring the average diameter or other characteristic dimension of the droplets. The "average diameter" of a plurality or series of droplets is the arithmetic average of the average diameters of each of the droplets. Those of ordinary skill in the art will be able to determine the average diameter (or other characteristic dimension) of a plurality or series of droplets, for example, using laser light scattering, microscopic examination, or other known techniques. The average diameter of a single droplet, in a non-spherical droplet, is the diameter of a perfect sphere having the same volume as the non-spherical droplet. The average diameter of a droplet (and/or of a plurality or series of droplets) may be, for example, less than about 1 mm, less than about 500 micrometers, less than about 200 micrometers, less than about 100 micrometers, less than about 75 micrometers, less than about 50 micrometers, less than about 25 micrometers, less than about 10 micrometers, or less than about 5 micrometers in some cases. The average diameter may also be at least about 1 micrometer, at least about 2 micrometers, at least about 3 micrometers, at least about 5 micrometers, at least about 10 micrometers, at least about 15 micrometers, or at least about 20 micrometers in certain cases.

Thus, using the methods and devices described herein, in some embodiments, an emulsion having a consistent size and/or number of droplets can be produced, and/or a consistent ratio of size and/or number of outer droplets to inner droplets (or other such ratios) can be produced for cases involving multiple emulsions. For example, in some cases, a single droplet within an outer droplet of predictable size can be used to provide a specific quantity of a drug. In addition, combinations of compounds or drugs may be stored, transported, or delivered in a droplet. For instance, hydrophobic and hydrophilic species can be delivered in a single, multiple emulsion droplet, as the droplet can include both hydrophilic and hydrophobic portions. The amount and concentration of each of these portions can be consistently controlled according to certain embodiments of the invention, which can provide for a predictable and consistent ratio of two or more species in a multiple emulsion droplet.

The term "determining," as used herein, generally refers to the analysis or measurement of a species, for example, quantitatively or qualitatively, and/or the detection of the presence or absence of the species. "Determining" may also refer to the analysis or measurement of an interaction between two or more species, for example, quantitatively or qualitatively, or by detecting the presence or absence of the interaction. Examples of suitable techniques include, but are not limited to, spectroscopy such as infrared, absorption, fluorescence, UV/visible, FTIR ("Fourier Transform Infrared Spectroscopy"), or Raman; gravimetric techniques; ellipsometry; piezoelectric measurements; immunoassays; electrochemical measurements; optical measurements such as optical density measurements; circular dichroism; light scattering measurements such as quasielectric light scattering; polarimetry; refractometry; or turbidity measurements.

The rate of production of droplets may be determined by the droplet formation frequency, which under many conditions can vary between approximately 100 Hz and 5,000 Hz. In some cases, the rate of droplet production may be at least about 200 Hz, at least about 300 Hz, at least about 500 Hz, at least about 750 Hz, at least about 1,000 Hz, at least about 2,000 Hz, at least about 3,000 Hz, at least about 4,000 Hz, or at least about 5,000 Hz, etc. The droplets may be produced under "dripping" or "jetting" conditions. In addition, production of large quantities of droplets can be facilitated by the parallel use of multiple devices in some instances. In some cases, relatively large numbers of devices may be used in parallel, for example at least about 10 devices, at least about 30 devices, at least about 50 devices, at least about 75 devices, at least about 100 devices, at least about 200 devices, at least about 300 devices, at least about 500 devices, at least about 750 devices, or at least about 1,000 devices or more may be operated in parallel. The devices may comprise different channels, orifices, microfluidics, etc. In some cases, an array of such devices may be formed by stacking the devices horizontally and/or vertically. The devices may be commonly controlled, or separately controlled, and can be provided with common or separate sources of fluids, depending on the application. Examples of such systems are also described in Int. Patent Application Serial No. PCT/US2010/000753, filed Mar. 12, 2010, entitled "Scale-up of Microfluidic Devices," by Romanowsky, et al., published as WO 2010/104597 on Sep. 16, 2010, incorporated herein by reference.

The fluids may be chosen such that the droplets remain discrete, relative to their surroundings. As non-limiting examples, a fluidic droplet may be created having an carrying fluid, containing a second fluidic droplet, containing a first fluidic droplet. In some cases, the carrying fluid and the first fluid may be identical or substantially identical; however, in other cases, the carrying fluid, the first fluid, and the second fluid may be chosen to be essentially mutually immiscible. One non-limiting example of a system involving three essentially mutually immiscible fluids is a silicone oil, a mineral oil, and an aqueous solution (i.e., water, or water containing one or more other species that are dissolved and/or suspended therein, for example, a salt solution, a saline solution, a suspension of water containing particles or cells, or the like). Another example of a system is a silicone oil, a fluorocarbon oil, and an aqueous solution.

Yet another example of a system is a hydrocarbon oil (e.g., hexadecane), a fluorocarbon oil, and an aqueous solution. Non-limiting examples of suitable fluorocarbon oils include HFE7500, octadecafluorodecahydronaphthalene:

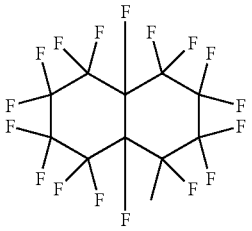

or 1-(1,2,2,3,3,4,4,5,5,6,6-undecafluorocyclohexyl)ethanol:

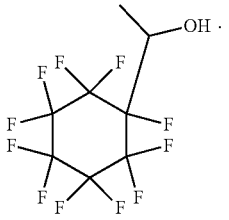

In the descriptions herein, multiple emulsions are often described with reference to a three phase system, i.e., having an outer or carrying fluid, a first fluid, and a second fluid. However, it should be noted that this is by way of example only, and that in other systems, additional fluids may be present within the multiple emulsion droplet. Accordingly, it should be understood that the descriptions such as the carrying fluid, first fluid, and second fluid are by way of ease of presentation, and that the descriptions herein are readily extendable to systems involving additional fluids, e.g., triple emulsions, quadruple emulsions, quintuple emulsions, sextuple emulsions, septuple emulsions, etc.

As fluid viscosity can affect droplet formation, in some cases the viscosity of any of the fluids in the fluidic droplets may be adjusted by adding or removing components, such as diluents, that can aid in adjusting viscosity. For example, in some embodiments, the viscosity of the first fluid and the second fluid are equal or substantially equal. This may aid in, for example, an equivalent frequency or rate of droplet formation in the first and second fluids. In other embodiments, the viscosity of the first fluid may be equal or substantially equal to the viscosity of the second fluid, and/or the viscosity of the first fluid may be equal or substantially equal to the viscosity of the carrying fluid. In yet another embodiment, the carrying fluid may exhibit a viscosity that is substantially different from the first fluid. A substantial difference in viscosity means that the difference in viscosity between the two fluids can be measured on a statistically significant basis. Other distributions of fluid viscosities within the droplets are also possible. For example, the second fluid may have a viscosity greater than or less than the viscosity of the first fluid (i.e., the viscosities of the two fluids may be substantially different), the first fluid may have a viscosity that is greater than or less than the viscosity of the carrying fluid, etc. It should also be noted that, in higher-order droplets, e.g., containing three, four, five, six, or more fluids, the viscosities may also be independently selected as desired, depending on the particular application.

In certain embodiments of the invention, the fluidic droplets (or a portion thereof) may contain additional entities or species, for example, other chemical, biochemical, or biological entities (e.g., dissolved or suspended in the fluid), cells, particles, gases, molecules, pharmaceutical agents, drugs, DNA, RNA, proteins, fragrance, reactive agents, biocides, fungicides, preservatives, chemicals, or the like. Cells, for example, can be suspended in a fluid emulsion. Thus, the species may be any substance that can be contained in any portion of an emulsion. The species may be present in any fluidic droplet, for example, within an inner droplet, within an outer droplet, etc. For instance, one or more cells and/or one or more cell types can be contained in a droplet.

In certain aspects of the invention, multiple emulsion droplets having very thin "shells" can be produced. For example, in such droplets, the volumetric ratio between a first, inner fluid and one or more surrounding fluids may be at least about 1:1, at least about 2:1, at least about 3:1, at least about 5:1, at least about 10:1, at least about 15:1, at least about 20:1, at least about 25:1, at least about 30:1, at least about 40:1, at least about 50:1, etc., or such that the inner fluid comprises at least about 50%, at least about 55%, at least about 60%, at least about 65%, at least about 70%, at least about 75%, at least about 80%, at least about 85%, at least about 90%, or at least about 95% of the volume of the multiple emulsion droplet with the surrounding fluid(s) forming the remainder of the volume of the multiple emulsion droplet.

The fluid "shell" surrounding a droplet may be defined as being between two interfaces, a first interface between a first fluid and a second fluid, and a second interface between the second fluid and a carrying fluid. The interfaces may have an average distance of separation (determined as an average over the droplet) that is no more than about 1 mm, about 300 micrometers, about 100 micrometers, about 30 micrometers, about 10 micrometers, about 3 micrometers, about 1 micrometers, etc. In some cases, the interfaces may have an average distance of separation defined relative to the average dimension of the droplet. For instance, the average distance of separation may be less than about 30%, less than about 25%, less than about 20%, less than about 15%, less than about 10%, less than about 5%, less than about 3%, less than about 2%, or less than about 1% of the average dimension of the droplet.

Certain aspects of the invention are generally directed to devices containing channels such as those described above. In some cases, some of the channels may be microfluidic channels, but in certain instances, not all of the channels are microfluidic. There can be any number of channels, including microfluidic channels, within the device, and the channels may be arranged in any suitable configuration. The channels may be all interconnected, or there can be more than one network of channels present. The channels may independently be straight, curved, bent, etc. In some cases, there may be a relatively large number and/or a relatively large length of channels present in the device. For example, in some embodiments, the channels within a device, when added together, can have a total length of at least about 100 micrometers, at least about 300 micrometers, at least about 500 micrometers, at least about 1 mm, at least about 3 mm, at least about 5 mm, at least about 10 mm, at least about 30 mm, at least 50 mm, at least about 100 mm, at least about 300 mm, at least about 500 mm, at least about 1 m, at least about 2 m, or at least about 3 m in some cases. As another example, a device can have at least 1 channel, at least 3 channels, at least 5 channels, at least 10 channels, at least 20 channels, at least 30 channels, at least 40 channels, at least 50 channels, at least 70 channels, at least 100 channels, etc.

In some embodiments, at least some of the channels within the device are microfluidic channels. "Microfluidic," as used herein, refers to a device, article, or system including at least one fluid channel having a cross-sectional dimension of less than about 1 mm. The "cross-sectional dimension" of the channel is measured perpendicular to the direction of net fluid flow within the channel. Thus, for example, some or all of the fluid channels in a device can have a maximum cross-sectional dimension less than about 2 mm, and in certain cases, less than about 1 mm. In one set of embodiments, all fluid channels in a device are microfluidic and/or have a largest cross sectional dimension of no more than about 2 mm or about 1 mm. In certain embodiments, the fluid channels may be formed in part by a single component (e.g. an etched substrate or molded unit). Of course, larger channels, tubes, chambers, reservoirs, etc. can be used to store fluids and/or deliver fluids to various elements or systems in other embodiments of the invention, for example, as previously discussed. In one set of embodiments, the maximum cross-sectional dimension of the channels in a device is less than 500 micrometers, less than 200 micrometers, less than 100 micrometers, less than 50 micrometers, or less than 25 micrometers.

A "channel," as used herein, means a feature on or in a device or substrate that at least partially directs flow of a fluid. The channel can have any cross-sectional shape (circular, oval, triangular, irregular, square or rectangular, or the like) and can be covered or uncovered. In embodiments where it is completely covered, at least one portion of the channel can have a cross-section that is completely enclosed, or the entire channel may be completely enclosed along its entire length with the exception of its inlets and/or outlets or openings. A channel may also have an aspect ratio (length to average cross sectional dimension) of at least 2:1, more typically at least 3:1, 4:1, 5:1, 6:1, 8:1, 10:1, 15:1, 20:1, or more. An open channel generally will include characteristics that facilitate control over fluid transport, e.g., structural characteristics (an elongated indentation) and/or physical or chemical characteristics (hydrophobicity vs. hydrophilicity) or other characteristics that can exert a force (e.g., a containing force) on a fluid. The fluid within the channel may partially or completely fill the channel. In some cases where an open channel is used, the fluid may be held within the channel, for example, using surface tension (i.e., a concave or convex meniscus).

The channel may be of any size, for example, having a largest dimension perpendicular to net fluid flow of less than about 5 mm or 2 mm, or less than about 1 mm, less than about 500 microns, less than about 200 microns, less than about 100 microns, less than about 60 microns, less than about 50 microns, less than about 40 microns, less than about 30 microns, less than about 25 microns, less than about 10 microns, less than about 3 microns, less than about 1 micron, less than about 300 nm, less than about 100 nm, less than about 30 nm, or less than about 10 nm. In some cases, the dimensions of the channel are chosen such that fluid is able to freely flow through the device or substrate. The dimensions of the channel may also be chosen, for example, to allow a certain volumetric or linear flow rate of fluid in the channel. Of course, the number of channels and the shape of the channels can be varied by any method known to those of ordinary skill in the art. In some cases, more than one channel may be used. For example, two or more channels may be used, where they are positioned adjacent or proximate to each other, positioned to intersect with each other, etc.

In certain embodiments, one or more of the channels within the device may have an average cross-sectional dimension of less than about 10 cm. In certain instances, the average cross-sectional dimension of the channel is less than about 5 cm, less than about 3 cm, less than about 1 cm, less than about 5 mm, less than about 3 mm, less than about 1 mm, less than 500 micrometers, less than 200 micrometers, less than 100 micrometers, less than 50 micrometers, or less than 25 micrometers. The "average cross-sectional dimension" is measured in a plane perpendicular to net fluid flow within the channel. If the channel is non-circular, the average cross-sectional dimension may be taken as the diameter of a circle having the same area as the cross-sectional area of the channel. Thus, the channel may have any suitable cross-sectional shape, for example, circular, oval, triangular, irregular, square, rectangular, quadrilateral, or the like. In some embodiments, the channels are sized so as to allow laminar flow of one or more fluids contained within the channel to occur.

The channel may also have any suitable cross-sectional aspect ratio. The "cross-sectional aspect ratio" is, for the cross-sectional shape of a channel, the largest possible ratio (large to small) of two measurements made orthogonal to each other on the cross-sectional shape. For example, the channel may have a cross-sectional aspect ratio of less than about 2:1, less than about 1.5:1, or in some cases about 1:1 (e.g., for a circular or a square cross-sectional shape). In other embodiments, the cross-sectional aspect ratio may be relatively large. For example, the cross-sectional aspect ratio may be at least about 2:1, at least about 3:1, at least about 4:1, at least about 5:1, at least about 6:1, at least about 7:1, at least about 8:1, at least about 10:1, at least about 12:1, at least about 15:1, or at least about 20:1.

As mentioned, the channels can be arranged in any suitable configuration within the device. Different channel arrangements may be used, for example, to manipulate fluids, droplets, and/or other species within the channels. For example, channels within the device can be arranged to create droplets (e.g., discrete droplets, single emulsions, double emulsions or other multiple emulsions, etc.), to mix fluids and/or droplets or other species contained therein, to screen or sort fluids and/or droplets or other species contained therein, to split or divide fluids and/or droplets, to cause a reaction to occur (e.g., between two fluids, between a species carried by a first fluid and a second fluid, or between two species carried by two fluids to occur), or the like.

Non-limiting examples of systems for manipulating fluids, droplets, and/or other species are discussed below. Additional examples of suitable manipulation systems can also be seen in U.S. patent application Ser. No. 11/246,911, filed Oct. 7, 2005, entitled "Formation and Control of Fluidic Species," by Link, et al., published as U.S. Patent Application Publication No. 2006/0163385 on Jul. 27, 2006; U.S. patent application Ser. No. 11/024,228, filed Dec. 28, 2004, entitled "Method and Apparatus for Fluid Dispersion," by Stone, et al., now U.S. Pat. No. 7,708,949, issued May 4, 2010; U.S. patent application Ser. No. 11/885,306, filed Aug. 29, 2007, entitled "Method and Apparatus for Forming Multiple Emulsions," by Weitz, et al., published as U.S. Patent Application Publication No. 2009/0131543 on May 21, 2009; and U.S. patent application Ser. No. 11/360,845, filed Feb. 23, 2006, entitled "Electronic Control of Fluidic Species," by Link, et al., published as U.S. Patent Application Publication No. 2007/0003442 on Jan. 4, 2007; each of which is incorporated herein by reference in its entirety.

Fluids may be delivered into channels within a device via one or more fluid sources. Any suitable source of fluid can be used, and in some cases, more than one source of fluid is used. For example, a pump, gravity, capillary action, surface tension, electroosmosis, centrifugal forces, etc. may be used to deliver a fluid from a fluid source into one or more channels in the device. Non-limiting examples of pumps include syringe pumps, peristaltic pumps, pressurized fluid sources, or the like. The device can have any number of fluid sources associated with it, for example, 1, 2, 3, 4, 5, 6, 7, 8, 9, 10, etc., or more fluid sources. The fluid sources need not be used to deliver fluid into the same channel, e.g., a first fluid source can deliver a first fluid to a first channel while a second fluid source can deliver a second fluid to a second channel, etc. In some cases, two or more channels are arranged to intersect at one or more intersections. There may be any number of fluidic channel intersections within the device, for example, 2, 3, 4, 5, 6, etc., or more intersections.

A variety of materials and methods, according to certain aspects of the invention, can be used to form devices or components such as those described herein, e.g., channels such as microfluidic channels, chambers, etc. For example, various devices or components can be formed from solid materials, in which the channels can be formed via micromachining, film deposition processes such as spin coating and chemical vapor deposition, laser fabrication, photolithographic techniques, etching methods including wet chemical or plasma processes, and the like. See, for example, *Scientific American,* 248:44-55, 1983 (Angell, et al).

In one set of embodiments, various structures or components of the devices described herein can be formed of a polymer, for example, an elastomeric polymer such as polydimethylsiloxane ("PDMS"), polytetrafluoroethylene ("PTFE" or Teflon®), or the like. For instance, according to one embodiment, a microfluidic channel may be implemented by fabricating the fluidic system separately using PDMS or other soft lithography techniques (details of soft lithography techniques suitable for this embodiment are discussed in the references entitled "Soft Lithography," by Younan Xia and George M. Whitesides, published in the *Annual Review of Material Science,* 1998, Vol. 28, pages 153-184, and "Soft Lithography in Biology and Biochemistry," by George M. Whitesides, Emanuele Ostuni, Shuichi Takayama, Xingyu Jiang and Donald E. Ingber, published in the *Annual Review of Biomedical Engineering,* 2001, Vol. 3, pages 335-373; each of these references is incorporated herein by reference).

Other examples of potentially suitable polymers include, but are not limited to, polyethylene terephthalate (PET), polyacrylate, polymethacrylate, polycarbonate, polystyrene, polyethylene, polypropylene, polyvinylchloride, cyclic olefin copolymer (COC), polytetrafluoroethylene, a fluorinated polymer, a silicone such as polydimethylsiloxane, polyvinylidene chloride, bis-benzocyclobutene ("BCB"), a polyimide, a fluorinated derivative of a polyimide, or the like. Combinations, copolymers, or blends involving polymers including those described above are also envisioned. The device may also be formed from composite materials, for example, a composite of a polymer and a semiconductor material.

In some embodiments, various structures or components of the device are fabricated from polymeric and/or flexible and/or elastomeric materials, and can be conveniently formed of a hardenable fluid, facilitating fabrication via molding (e.g. replica molding, injection molding, cast molding, etc.). The hardenable fluid can be essentially any fluid that can be induced to solidify, or that spontaneously solidifies, into a solid capable of containing and/or transporting fluids contemplated for use in and with the fluidic network. In one embodiment, the hardenable fluid comprises a polymeric liquid or a liquid polymeric precursor (i.e. a "prepolymer"). Suitable polymeric liquids can include, for example, thermoplastic polymers, thermoset polymers, waxes, metals, or mixtures or composites thereof heated above their melting point. As another example, a suitable polymeric liquid may include a solution of one or more polymers in a suitable solvent, which solution forms a solid polymeric material upon removal of the solvent, for example, by evaporation. Such polymeric materials, which can be solidified from, for example, a melt state or by solvent evaporation, are well known to those of ordinary skill in the art. A variety of polymeric materials, many of which are elastomeric, are suitable, and are also suitable for forming molds or mold masters, for embodiments where one or both of the mold masters is composed of an elastomeric material. A non-limiting list of examples of such polymers includes polymers of the general classes of silicone polymers, epoxy polymers, and acrylate polymers. Epoxy polymers are characterized by the presence of a three-membered cyclic ether group commonly referred to as an epoxy group, 1,2-epoxide, or oxirane. For example, diglycidyl ethers of bisphenol A can be used, in addition to compounds based on aromatic amine, triazine, and cycloaliphatic backbones. Another example includes the well-known Novolac polymers. Non-limiting examples of silicone elastomers suitable for use according to the invention include those formed from precursors including the chlorosilanes such as methylchlorosilanes, ethylchlorosilanes, phenylchlorosilanes, etc.

Silicone polymers are used in certain embodiments, for example, the silicone elastomer polydimethylsiloxane. Non-limiting examples of PDMS polymers include those sold under the trademark Sylgard by Dow Chemical Co., Midland, Mich., and particularly Sylgard 182, Sylgard 184, and Sylgard 186. Silicone polymers including PDMS have several beneficial properties simplifying fabrication of various structures of the invention. For instance, such materials are inexpensive, readily available, and can be solidified from a prepolymeric liquid via curing with heat. For example, PDMSs are typically curable by exposure of the prepolymeric liquid to temperatures of about, for example, about 65° C. to about 75° C. for exposure times of, for example, about an hour. Also, silicone polymers, such as PDMS, can be elastomeric and thus may be useful for forming very small features with relatively high aspect ratios, necessary in certain embodiments of the invention. Flexible (e.g., elastomeric) molds or masters can be advantageous in this regard.

One advantage of forming structures such as microfluidic structures or channels from silicone polymers, such as PDMS, is the ability of such polymers to be oxidized, for example by exposure to an oxygen-containing plasma such as an air plasma, so that the oxidized structures contain, at their surface, chemical groups capable of cross-linking to other oxidized silicone polymer surfaces or to the oxidized surfaces of a variety of other polymeric and non-polymeric materials. Thus, structures can be fabricated and then oxidized and essentially irreversibly sealed to other silicone polymer surfaces, or to the surfaces of other substrates reactive with the oxidized silicone polymer surfaces, without the need for separate adhesives or other sealing means. In most cases, sealing can be completed simply by contacting an oxidized silicone surface to another surface without the need to apply auxiliary pressure to form the seal. That is, the pre-oxidized silicone surface acts as a contact adhesive against suitable mating surfaces. Specifically, in addition to being irreversibly sealable to itself, oxidized silicone such as oxidized PDMS can also be sealed irreversibly to a range of oxidized materials other than itself including, for example, glass, silicon, silicon oxide, quartz, silicon nitride, polyethylene, polystyrene, glassy carbon, and epoxy polymers, which have been oxidized in a similar fashion to the PDMS surface (for example, via exposure to an oxygen-containing plasma). Oxidation and sealing methods useful in the context of the present invention, as well as overall molding techniques, are described in the art, for example, in an article entitled "Rapid Prototyping of Microfluidic Systems and Polydimethylsiloxane," *Anal. Chem.,* 70:474-480, 1998 (Duffy et al.), incorporated herein by reference.

Another advantage to forming channels or other structures (or interior, fluid-contacting surfaces) from oxidized silicone polymers is that these surfaces can be much more hydrophilic than the surfaces of typical elastomeric polymers (where a hydrophilic interior surface is desired). Such hydrophilic channel surfaces can thus be more easily filled and wetted with aqueous solutions than can structures comprised of typical, unoxidized elastomeric polymers or other hydrophobic materials.

In some aspects, such devices may be produced using more than one layer or substrate, e.g., more than one layer of PDMS. For instance, devices having channels with multiple heights and/or devices having interfaces positioned such as described herein may be produced using more than one layer or substrate, which may then be assembled or bonded together, e.g., e.g., using plasma bonding, to produce the final device. In some embodiments, one or more of the layers may have one or more mating protrusions and/or indentations which are aligned to properly align the layers, e.g., in a lock-and-key fashion. For example, a first layer may have a protrusion (having any suitable shape) and a second layer may have a corresponding indentation which can receive the protrusion, thereby causing the two layers to become properly aligned with respect to each other.

In some aspects, one or more walls or portions of a channel may be coated, e.g., with a coating material, including photoactive coating materials. For example, in some embodiments, each of the microfluidic channels at the common junction may have substantially the same hydrophobicity, although in other embodiments, various channels may have different hydrophobicities. For example a first channel (or set of channels) at a common junction may exhibit a first hydrophobicity, while the other channels may exhibit a second hydrophobicity different from the first hydrophobicity, e.g., exhibiting a hydrophobicity that is greater or less than the first hydrophobicity. Non-limiting examples of systems and methods for coating microfluidic channels, for example, with sol-gel coatings, may be seen in International Patent Application No. PCT/US2009/000850, filed Feb. 11, 2009, entitled "Surfaces, Including Microfluidic Channels, With Controlled Wetting Properties," by Abate, et al., published as WO 2009/120254 on Oct. 1, 2009, and International Patent Application No. PCT/US2008/009477, filed Aug. 7, 2008, entitled "Metal Oxide Coating on Surfaces," by Weitz, et al., published as WO 2009/020633 on Feb. 12, 2009, each incorporated herein by reference in its entirety.

As mentioned, in some cases, some or all of the channels may be coated, or otherwise treated such that some or all of the channels, including the inlet and daughter channels, each have substantially the same hydrophilicity. The coating materials can be used in certain instances to control and/or alter the hydrophobicity of the wall of a channel. In some embodiments, a sol-gel is provided that can be formed as a coating on a substrate such as the wall of a channel such as a microfluidic channel. One or more portions of the sol-gel can be reacted to alter its hydrophobicity, in some cases. For example, a portion of the sol-gel may be exposed to light, such as ultraviolet light, which can be used to induce a chemical reaction in the sol-gel that alters its hydrophobicity. The sol-gel may include a photoinitiator which, upon exposure to light, produces radicals. Optionally, the photoinitiator is conjugated to a silane or other material within the sol-gel. The radicals so produced may be used to cause a condensation or polymerization reaction to occur on the surface of the sol-gel, thus altering the hydrophobicity of the surface. In some cases, various portions may be reacted or left unreacted, e.g., by controlling exposure to light (for instance, using a mask).

Thus, in one aspect of the invention, a coating on the wall of a channel may be a sol-gel. As is known to those of ordinary skill in the art, a sol-gel is a material that can be in a sol or a gel state. In some cases, the sol-gel material may comprise a polymer. The sol state may be converted into the gel state by chemical reaction. In some cases, the reaction may be facilitated by removing solvent from the sol, e.g., via drying or heating techniques. Thus, in some cases, e.g., as discussed below, the sol may be pretreated before being used, for instance, by causing some condensation to occur within the sol. Sol-gel chemistry is, in general, analogous to polymerization, but is a sequence of hydrolysis of the silanes yielding silanols and subsequent condensation of these silanols to form silica or siloxanes.

For example, the sol-gel coating may be made more hydrophobic by incorporating a hydrophobic polymer in the sol-gel. For instance, the sol-gel may contain one or more silanes, for example, a fluorosilane (i.e., a silane containing at least one fluorine atom) such as heptadecafluorosilane or heptadecafluorooctylsilane, or other silanes such as methyltriethoxy silane (MTES) or a silane containing one or more lipid chains, such as octadecylsilane or other $CH_3(CH_2)_n$—silanes, where n can be any suitable integer.

The sol-gel may be present as a coating on the substrate, and the coating may have any suitable thickness. For instance, the coating may have a thickness of no more than about 100 micrometers, no more than about 30 micrometers, no more than about 10 micrometers, no more than about 3 micrometers, or no more than about 1 micrometer.

The hydrophobicity of the sol-gel coating can be modified, for instance, by exposing at least a portion of the sol-gel coating to a condensation or polymerization reaction to react a polymer to the sol-gel coating. The polymer reacted to the sol-gel coating may be any suitable polymer, and may be chosen to have certain hydrophobicity properties. For instance, the polymer may be chosen to be more hydrophobic or more hydrophilic than the substrate and/or the sol-gel coating.

Accordingly, some aspects of the present invention are generally directed to systems and methods for coating such a sol-gel onto at least a portion of a substrate. In one set of embodiments, a substrate, such as a microfluidic channel, is exposed to a sol, which is then treated to form a sol-gel coating. In some cases, the sol can also be pretreated to cause partial condensation or polymerization to occur.

In certain embodiments, a portion of the coating may be treated to alter its hydrophobicity (or other properties) after the coating has been introduced to the substrate. In some cases, the coating is exposed to a solution containing a monomer and/or an oligomer, which is then condensed or polymerized to bond to the coating, as discussed above. For instance, a portion of the coating may be exposed to heat or to light such as ultraviolet right, which may be used to initiate a free radical polymerization reaction to cause polymerization to occur.

The following documents are incorporated herein by reference: U.S. patent application Ser. No. 11/885,306, filed Aug. 29, 2007, entitled "Method and Apparatus for Forming Multiple Emulsions," by Weitz, et al., published as U.S. Patent Application Publication No. 2009/0131543 on May 21, 2009; U.S. patent application Ser. No. 12/058,628, filed Mar. 28, 2008, entitled "Emulsions and Techniques for Formation," by Chu, et al., now U.S. Pat. No. 7,776,927, issued Aug. 17, 2010; International Patent Application No. PCT/US2010/000763, filed Mar. 12, 2010, entitled "Controlled Creation of Multiple Emulsions," by Weitz, et al., published as WO 2010/104604 on Sep. 16, 2010; International Patent Application No. PCT/US2010/047458, filed Sep. 1, 2010, entitled "Multiple Emulsions Created Using Junctions," by Weitz, et al.; and International Patent Application No. PCT/US2010/047467, filed Sep. 1, 2010, entitled "Multiple Emulsions Created Using Jetting and Other Techniques," by Weitz, et al. Also incorporated by reference herein in its entirety is U.S. Provisional Patent Application Ser. No. 61/489,211, filed May 23, 2011, entitled "Control of Emulsions, Including Multiple Emulsions," by Rotem, et al.

The following examples are intended to illustrate certain embodiments of the present invention, but do not exemplify the full scope of the invention.

EXAMPLE 1

Photolithography is an accurate, reproducible, and easy method for fabricating micrometer-scale devices. However, it is not easy to produce double emulsions in such devices. One solution for double emulsification is controlling the wetting affinity of the device on a local basis. For example, water/oil/water emulsions (w/o/w) may be prepared where the first emulsifying step is locally hydrophobic and the second emulsifying step is locally hydrophilic. See, e.g., International Patent Application No. PCT/US2010/047458, filed Sep. 1, 2010, entitled "Multiple Emulsions Created Using Junctions," by Weitz, et al., incorporated herein by reference.

Another method for overcoming wetting constraints in such devices is by controlling the geometry of the emulsifying steps. By creating a more expanded drop making junction, a continuous fluid may be allowed to flow around the dispersed fluid, shielding it from the walls and preventing it from wetting the walls of the device, thus eliminating the problem of wetting that existed in the originally confined geometries.

Figure 2A:
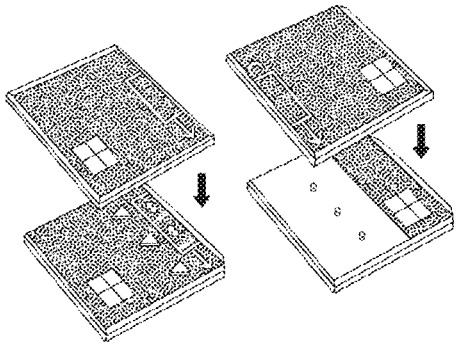
FIGS. 2A-2E illustrate alignment of layers within a device, in another embodiment of the invention.
Figure 2B:
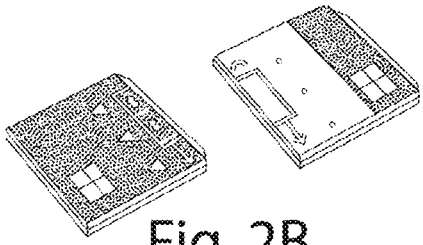
Figure 2C:
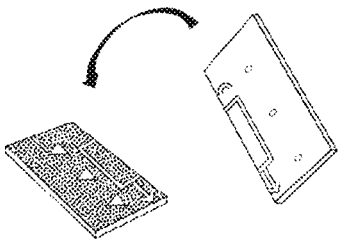
Figure 2D:
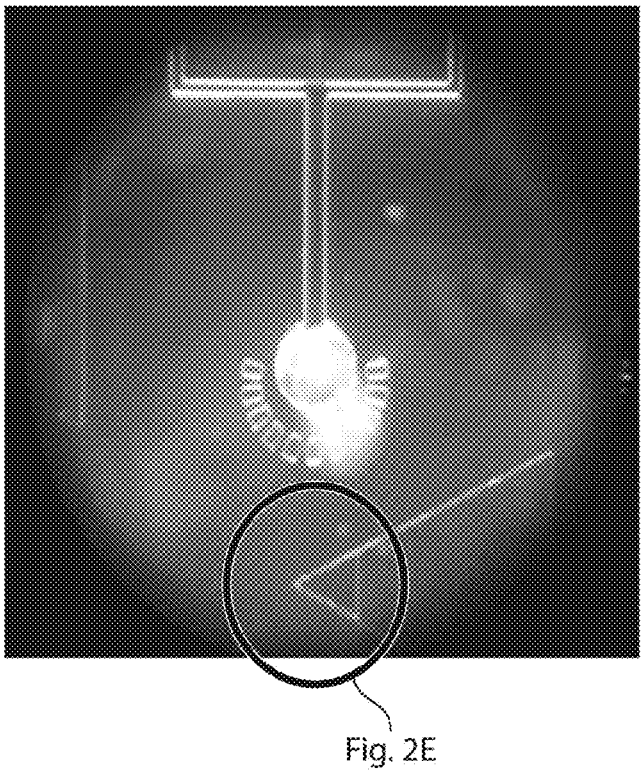
Figure 2E:
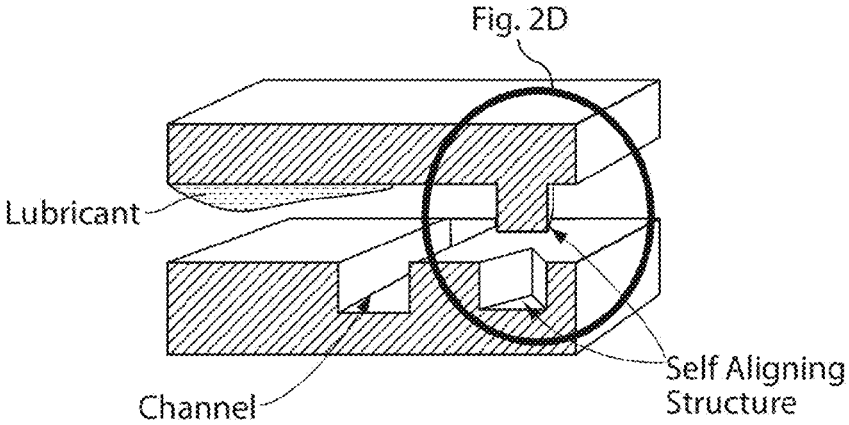
Figure 3A:
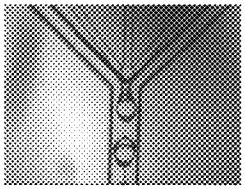
FIGS. 3A-3E illustrate the production of double emulsions in certain embodiments of the invention.
Figure 3B:
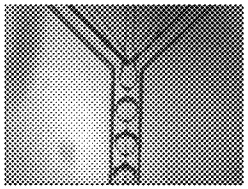
Figure 3C:
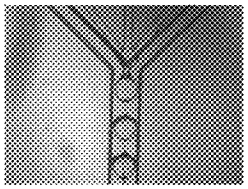
Figure 3D:
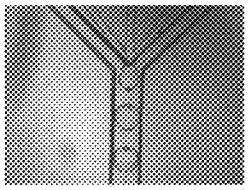
Figure 3E:
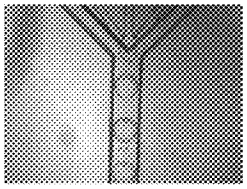

Photolithographic exposures can be repeated to make multilayered devices, but some topologies such as the one in FIG. 1 can sometimes be difficult to achieve using multiple exposures, and may require a complementary method of stacking up devices after fabrication. One method to align stacks of micrometer-scale devices relies on matching "locks and keys" that are an inherent part of the device (FIG. 2). FIG. 2A shows a two layered master prepared using photolithography. The alignment of the two layers determines the alignment of the two PDMS halves (in FIG. 2C). FIG. 2B shows the two layered device cut in half and FIG. 2C shows the two halves bonded facing each other, e.g., using plasma bonding. FIGS. 2D and 2E show aligning structures protruding on one half of the device and embossed on the facing half, so that they fit together to perform self alignment of the two halves. Lubrication of the contact surface with water may be used to temporarily disable the plasma boding until baking after the alignment process.

In some cases, single step emulsification may be achieved with such a two thickness device. For example, a hydrophobic device may be used to emulsify water in oil at the point of contact between the fluids. Designing this point of contact close to the second emulsification site can result in a single step process. This process can also produce double emulsion in some embodiments with very thin shells, e.g., with volume fractions of 1:25 shell/inner phase (FIG. 3). This figure shows a single-step, two-thickness device for w/o/w double emulsions formed with different volume fractions, from 1:1 inner:shell volume fraction in the left image to 25:1 inner:shell fraction on the right.

While several embodiments of the present invention have been described and illustrated herein, those of ordinary skill in the art will readily envision a variety of other means and/or structures for performing the functions and/or obtaining the results and/or one or more of the advantages described herein, and each of such variations and/or modifications is deemed to be within the scope of the present invention. More generally, those skilled in the art will readily appreciate that all parameters, dimensions, materials, and configurations described herein are meant to be exemplary and that the actual parameters, dimensions, materials, and/or configurations will depend upon the specific application or applications for which the teachings of the present invention is/are used. Those skilled in the art will recognize, or be able to ascertain using no more than routine experimentation, many equivalents to the specific embodiments of the invention described herein. It is, therefore, to be understood that the foregoing embodiments are presented by way of example only and that, within the scope of the appended claims and equivalents thereto, the invention may be practiced otherwise than as specifically described and claimed. The present invention is directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the scope of the present invention.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

It should also be understood that, unless clearly indicated to the contrary, in any methods claimed herein that include more than one step or act, the order of the steps or acts of the method is not necessarily limited to the order in which the steps or acts of the method are recited.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03.

What is claimed is:

1. A method of creating an emulsion encapsulating a species, the method comprising:

providing a microfluidic device comprising a first junction of microfluidic channels comprising at least a first, second, and third microfluidic channels in fluidic communication, the first junction in fluid communication at an interface with a second junction of microfluidic channels comprising at least fourth, fifth, and sixth microfluidic channels in fluid communication, each of the first, second, and third microfluidic channels having a respective cross-sectional area at the first junction and each of the fourth, fifth, and sixth microfluidic channels having a respective cross-sectional area at a second junction, wherein the interface has a cross-sectional area smaller than the smallest cross-sectional areas of the fourth, fifth, and sixth microfluidic channels; and creating an emulsion encapsulating a species at the first and second junctions of microfluidic channels.

2. The method of claim 1, wherein the emulsion is a double emulsion.

3. The method of claim 1, wherein each of the microfluidic channels at the first and second junctions have substantially the same hydrophobicity.

4. The method of claim 1, wherein one or more of the microfluidic channels at the first and second junctions have different hydrophobicity.

5. The method of claim 1, wherein the species is: a particle, a chemical entity, a biochemical species, a biological entity, cells, a single cell, a pharmaceutical agent, drugs, a nucleic acid, proteins, a nanoparticle, quantum dots, fluorescent species or any combinations thereof.

6. The method of claim 5, wherein the biochemical species is a nucleic acid.

7. The method of claim 6, wherein the nucleic acid is: siRNA, RNAi, DNA or any combinations thereof.

8. The method of claim 5, wherein the species is cells.

9. The method of claim 5, wherein the species is a single cell.

10. The method of claim 5, wherein the species is a particle and cells.

11. The method of claim 5, wherein the species is a particle and a single cell.

* * * * *